US008384652B2

(12) United States Patent
Shih et al.

(10) Patent No.: US 8,384,652 B2
(45) Date of Patent: Feb. 26, 2013

(54) LIQUID CRYSTAL DISPLAY

(75) Inventors: Ching-Wen Shih, Pinghung (TW); Hung-Yu Lin, Dadu Shiang (TW); Yu-Yeh Chen, Taipei (TW)

(73) Assignee: Chimei Innolux Corporation, Miao-Li County (TW)

( * ) Notice: Subject to any disclaimer, the term of this patent is extended or adjusted under 35 U.S.C. 154(b) by 1412 days.

(21) Appl. No.: 11/607,456

(22) Filed: Dec. 1, 2006

(65) Prior Publication Data

US 2007/0126678 A1 Jun. 7, 2007

(30) Foreign Application Priority Data

Dec. 2, 2005 (TW) ..... 94142677 A

(51) Int. Cl.
*G09G 3/36* (2006.01)

(52) U.S. Cl. ..... 345/102; 345/87; 345/204; 345/205; 345/214; 313/484; 359/237; 362/561

(58) Field of Classification Search ..... 345/204, 345/102, 87
See application file for complete search history.

(56) References Cited

U.S. PATENT DOCUMENTS

| | | | | |
|---|---|---|---|---|
| 6,870,530 | B2 | 3/2005 | Bu et al. | |
| 7,106,294 | B2 * | 9/2006 | Kumamoto et al. | 345/102 |
| 7,185,986 | B2 * | 3/2007 | Taoka et al. | 353/31 |
| 7,656,374 | B2 * | 2/2010 | Shen et al. | 345/87 |
| 8,139,157 | B2 * | 3/2012 | Someya et al. | 348/672 |
| 8,217,880 | B2 * | 7/2012 | Yamato et al. | 345/94 |
| 2004/0012551 | A1 * | 1/2004 | Ishii | 345/87 |
| 2005/0231269 | A1 | 10/2005 | Kim et al. | |
| 2005/0264544 | A1 | 12/2005 | Hsu | |
| 2005/0285841 | A1 * | 12/2005 | Lin | 345/102 |
| 2006/0279494 | A1 * | 12/2006 | Yen et al. | 345/84 |

FOREIGN PATENT DOCUMENTS

| | | |
|---|---|---|
| EP | 1596353 A2 | 11/2005 |
| TW | 502234 | 9/2002 |

OTHER PUBLICATIONS

Igarashi et al., "31.2: Proposal of the Perceptive Parameter Motion Picture Response Time (MPRT)", *SID 03 Digest*, pp. 1039-1041.

Sasaki et al., "29.2: Motion Picture Simulation for Designing High-Picture-Quality Hold-Type Displays", *SID 02 Digest*, pp. 926-929.

* cited by examiner

*Primary Examiner* — Grant Sitta

(74) *Attorney, Agent, or Firm* — J.C. Patents

(57) ABSTRACT

A method of operating a display includes providing light having a luminance that varies periodically, overdriving a pixel circuit of the display, and modulating the light using the pixel circuit to generate modulated light. The amount of overdrive and the phase of the light relative to the overdriving of the pixel circuit are controlled such that the modulated light has a predetermined level of uniformity.

41 Claims, 16 Drawing Sheets

Table 1

| N-BET(ms) | 0 | 32 | 64 | 96 | 128 | 160 | 192 | 224 | 255 |
|---|---|---|---|---|---|---|---|---|---|
| 0 | | 111.3 | 60.4 | 39.2 | 30.2 | 19.8 | 18.2 | 14.4 | 21 |
| 32 | 11.5 | | 27.9 | 21.5 | 19.3 | 17.9 | 15 | 11.3 | 11.2 |
| 64 | 11.4 | 19.3 | | 18.5 | 17.4 | 15.1 | 12.2 | 10.8 | 11.3 |
| 96 | 11.4 | 16.3 | 15.2 | | 16.1 | 13.9 | 11.9 | 11.4 | 11.3 |
| 128 | 11.4 | 14.4 | 14.3 | 17.2 | | 13.8 | 12.3 | 10.8 | 11.3 |
| 160 | 11.3 | 12.7 | 14.4 | 16.7 | 15.8 | | 10.9 | 10.9 | 11.4 |
| 192 | 11.4 | 13.4 | 13.6 | 16.2 | 15.2 | 13.4 | | 11.3 | 11.6 |
| 224 | 11.4 | 12.8 | 13.9 | 15.3 | 15.5 | 13.3 | 11.6 | | 12 |
| 255 | 11.6 | 12.6 | 14.6 | 15.5 | 15.9 | 13.9 | 12.4 | 11.4 | |
| | | | | | | | MPRT(ms) | | 16.7 |

FIG. 17

Table 2

| N-BET(ms) | 0 | 32 | 64 | 96 | 128 | 160 | 192 | 224 | 255 |
|---|---|---|---|---|---|---|---|---|---|
| 0 | | 15 | 24.1 | 22.9 | 22.5 | 14 | 12.5 | 11.3 | 21.9 |
| 32 | 11.5 | | 32.2 | 24.7 | 11.7 | 10.8 | 11.1 | 10.7 | 11.3 |
| 64 | 11.4 | 10.5 | | 11.2 | 11 | 11 | 10.9 | 11 | 11.4 |
| 96 | 11.3 | 11.3 | 10.8 | | 10.8 | 11.4 | 11 | 11 | 11.5 |
| 128 | 11.3 | 11.1 | 11.2 | 11.5 | | 11.6 | 11.3 | 10.7 | 11.5 |
| 160 | 11.3 | 11.1 | 11 | 11.1 | 10.9 | | 11.8 | 10.8 | 11.5 |
| 192 | 11.3 | 11.1 | 10.9 | 11 | 11.3 | 10.9 | | 11.2 | 11.8 |
| 224 | 11.3 | 10.9 | 11 | 11.1 | 11.1 | 11.1 | 11.3 | | 12.1 |
| 255 | 11.4 | 11.2 | 10.9 | 11 | 11.3 | 11.2 | 11.2 | 11.2 | |
| | | | | | | | MPRT(ms) | | 12.4 |

FIG. 18

LIQUID CRYSTAL DISPLAY

CROSS-REFERENCE TO RELATED APPLICATIONS

This application claims priority to Taiwan application serial no. 94142677, filed Dec. 2, 2005, the contents of which are incorporated herein by reference.

BACKGROUND

When a motion picture having moving objects is shown on a liquid crystal display, human eyes may perceive the edges of the objects as blurred due to persistence of vision and slow response time of the display. For example, referring to FIG. 1A, an LCD 100 shows a black object 106 that moves from a first position 102 at time t1 to a second position 104 at time t2 against a white background (the left portion of the object 106 is outside of the display area at time t2). Assuming that the difference between t1 and t2 is short, the human eye at time t2 may perceive an image shown in FIG. 1B, in which the boundary between the black object 106 and the white background (108) is blurred.

Referring to FIG. 1C, a graph 110 showing a motion picture response curve (MPRC) 112 can be used to evaluate the blurriness effect. The MPRC 112 is a brightness distribution curve and represents the perception of an edge of a moving object by human eyes. A steep motion picture response curve indicates that the edges of the motion picture are clear, whereas a gradually sloped motion picture response curve indicates that the edges of the motion picture may be blurred. A blur edge width (BEW) parameter is defined as the number of pixels between a location 114 having 10% full luminance and a location 116 having 90% full luminance near the edge of the object being examined. A narrower blur edge width indicates that the edge of the object is better defined, whereas a wider blur edge width indicates that the edge of the object is less well defined and may be blurred.

The quality of displayed motion pictures can be expressed by BEW normalized by the motion speed of the moving object expressed in pixels per frame:

$$N\text{-BEW (frame)}=\text{blur edge width (pixel)/moving speed } V\text{ (pixel/frame)}. \quad \text{(Equ. 1)}$$

The N-BEW value can be calculated for a number of gray levels, and their values are averaged. A motion picture response time (MPRT) parameter can be derived by multiplying the averaged N-BEW values by the frame time $T_f$ of the liquid crystal display:

$$\text{MPRT (seconds)}=N\text{-BEW (averaged over gray levels)}\times\text{frame time } T_f\text{ (seconds/frame)}. \quad \text{(Equ. 2)}$$

A smaller motion picture response time indicates a better motion picture quality, whereas a larger motion picture response time indicates a poorer motion picture quality.

SUMMARY

In one aspect, in general, a method of operating a display includes overdriving pixel circuits of the display to correspond to the driving of a periodically varying light, and modulating the light using the pixel circuits. The amount of overdrive is configured such that the modulated light has a predetermined level of uniformity. This enables the display to have a better motion picture quality.

In another aspect, in general, a method of operating a display includes driving a periodically varying light to correspond to overdriving of pixels of the display. The phase of the light relative to the timing of overdrive, and the amount of overdrive, are configured to cause the modulated light to have a predetermined level of uniformity.

Implementations of the method can include one or more of the following features. The phase of the periodically varying light relative to a switching point when a voltage for driving a pixel changes from an overdrive voltage to a normal voltage is selected to achieve a better overall motion image quality.

In another aspect, in general, a method of operating a display includes providing light having a luminance that varies periodically, overdriving a pixel circuit of the display, modulating the light by using the pixel circuit to generate modulated light, and controlling the overdriving and a phase of the light relative to the overdriving such that the modulated light has a predetermined level of uniformity.

Implementations of the method can include one or more of the following features. Pulses of the modulated light have a predetermined level of uniformity. During a period that the pixel circuit starts to change from a first gray level to a second gray level and before the pixel circuit starts to change from the second gray level to a third gray level, pulses of the modulated light have a predetermined level of uniformity. The amount of overdrive and the phase of the light are controlled to cause the peaks of the luminance of the pulses to have a predetermined level of uniformity.

In some examples, the amount of overdrive and the phase of the light are controlled to cause the peaks of the brightness of the pulses to have a predetermined level of uniformity. The amount of overdrive and the phase of the light are controlled to cause the first pulse of the modulated light to have a peak value that is not less than a predetermined percentage (e.g., 90%) of a target peak value. The peak value of the second pulse of the modulated light is not more than a predetermined percentage (e.g., 110%) of the target peak value.

In some examples, the amount of overdrive and the phase of the light are controlled to cause the first pulse of the modulated light to have a first integrated value that is not less than a predetermined percentage (e.g., 90%) of a second integrated value of a target pulse having a target peak value, the first and second integrated values being determined by integrating the first and target pulses, respectively, over the same length of time. The second pulse of the modulated light has a third integrated value that is not more than a predetermined percentage (e.g., 110%) of the second integrated value.

In some examples, the amount of overdrive and the phase of the light are controlled to cause the first pulse to have a first integrated value that is within a predetermined percentage range (e.g., 30% to 70%) of a second integrated value of a target pulse having a target peak value, the first integrated value being determined by integrating the first pulse from the start of driving the pixel circuit to a time that the first pulse reaches a peak value, and the second integrated value being determined by integrating the second pulse over a period of the second pulse.

The method includes overdriving a row of pixel circuits of the display and modulating the light using the row of pixel circuits, wherein the amount of overdrive applied to each pixel circuit and the phase of the light are controlled such that, for each pixel circuit, the pulses of the light modulated by the pixel circuit have a predetermined level of uniformity. The light varies at a first frequency f1 that is substantially the same as a second frequency f2 at which the pixel circuit is driven. When the pixel circuit switches from a lower gray level to a higher gray level, the pixel circuit reaches a maximum transmissivity within less than 1 (2*f1) after the light reaches a local maximum luminance level. The first frequency f1 is lower than the second frequency f2. When the pixel circuit switches from a lower gray level to a higher gray level, the pixel circuit reaches a maximum transmissivity within less than (1−f1/f2)*(1/f1) before the light reaches a local maximum luminance level. The display can be, e.g., a liquid crystal display.

In another aspect, in general, a method of designing a display includes driving pixel circuits of the display according to a first frequency such that, for each pixel circuit, a pixel data voltage for driving the pixel circuit switch to different levels at predefined time points. The method includes driving a light source according to a second frequency to generate light having a luminance that varies according to the second frequency, modulating the light using the pixel circuits to generate modulated light representing images, and adjusting the phase of the light relative to the driving of the pixel circuits to reduce blurring of the images.

Implementations of the method can include one or more of the following features. The phase of the light is adjusted to be in advance of the driving of the pixel circuits such that peaks of the light occur in advance of the predefined time points within less than half a period of a luminance waveform of the light.

In another aspect, in general, a method of operating a display includes providing a first set of overdrive pixel data and a second set of overdrive pixel data, selecting one of the first and second sets of overdrive pixel data based on whether a light source of the display generates (a) light having a substantially constant luminance or (b) light having a luminance that varies periodically, and overdriving pixel circuits of the display using the selected set of overdrive pixel data.

Implementations of the method can include one or more of the following features. The method includes, when the luminance of the light varies periodically, modulating the light using the pixel circuits to generate modulated light, and controlling a phase of the light relative to the overdriving of the pixel circuits to cause pulses of the modulated light to have a predetermined level of uniformity. The first pulse of the modulated light has a peak value that is not less than, e.g., 90% of a target peak value. The second pulse of the modulated light has a peak value that is not more than, e.g., 110% of a target peak value.

In another aspect, in general, a display includes pixel circuits, a light source, and a storage device storing a first set of overdrive pixel data and a second set of overdrive pixel data. The first set of overdrive pixel data is used when the light source generates light having a substantially constant luminance, and the second set of overdrive pixel data is used when the light source generates light having a luminance that varies periodically. A driving module receives one of the first and second sets of overdrive data and overdrives the pixel circuits using the received set of overdrive data.

Implementations of the display can include one or more of the following features. The second set of overdrive pixel data are configured to cause pulses of the modulated light to have a predetermined level of uniformity. The second set of overdrive pixel data are configured to cause the first pulse of the modulated light to have a peak value that is not less than, e.g., 90% of a target peak value. The second set of overdrive pixel data are configured to cause the second pulse of the modulated light to have a peak value that is not more than, e.g., 110% of a target peak value. The storage device stores a first lookup table and a second lookup table, the first lookup table including the first set of overdrive data, the second lookup table including the second set of overdrive data.

In another aspect, in general, a display includes a light source for generating light having a luminance that varies periodically, pixel circuits for modulating the light to generate modulated light, a driving module for overdriving the pixel circuits using overdrive data, and a controller for controlling a phase of the light relative to the driving of the pixel circuits such that, during a period that the pixel circuit starts to change from a first gray level to a second gray level and before the pixel circuit starts to change from the second gray level to a third gray level, pulses of the modulated light have a predetermined level of uniformity.

Implementations of the display can include one or more of the following features. In some examples, the controller controls the phase of the light such that the first pulse of the modulated light has a peak value that is not less than a predetermined percentage (e.g., 90%) of a target peak value. The controller controls the phase of the light such that the second pulse of the modulated light has a peak value that is not more than a predetermined percentage (e.g., 110%) of a target peak value. Each of the pixel circuits includes, e.g., a liquid crystal layer. In some examples, the controller controls the phase of the light such that the first pulse of the modulated light has a first integrated value that is not less than a predetermined percentage (e.g., 90%) of a second integrated value of a target pulse having a target peak value, the first and second integrated values being derived by integrating the first and target pulses, respectively, over the same length of time. The second pulse of the modulated light has a third integrated value that is not more than a predetermined percentage (e.g., 110%) of the second integrated value.

Advantages of the displays and methods may include one or more of the following. The blurry edges and double-edges in motion images can be improved. The motion picture response time can be shortened. The overall quality of motion images shown on the display can be improved.

DESCRIPTION OF DRAWINGS

FIGS. 17 and 18 are tables.

DETAILED DESCRIPTION

Figure 1A:
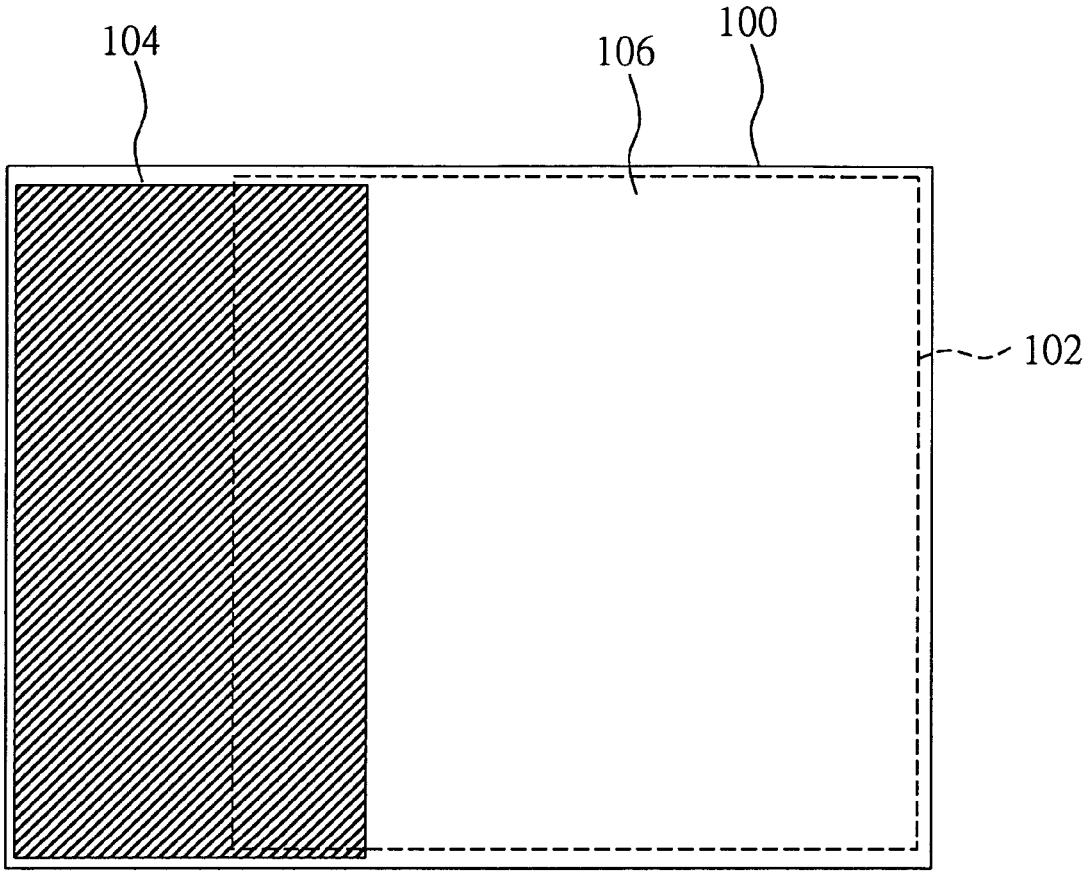
FIG. 1A(PRIOR ART)
FIG. 1A is a diagram of a display showing a moving object.
Figure 1B:
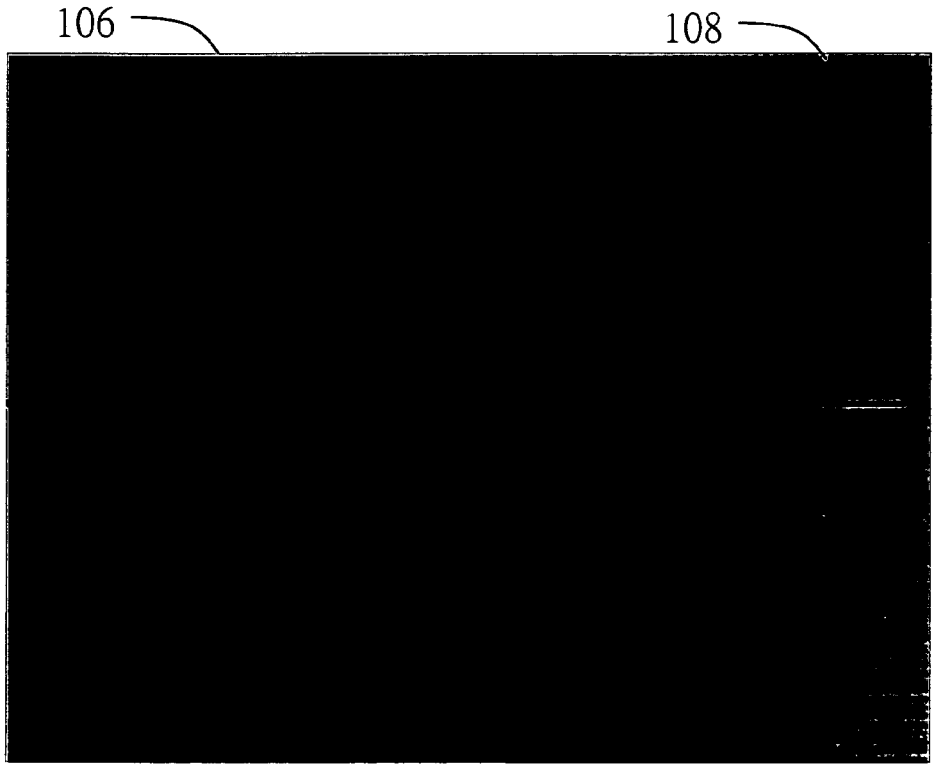
FIG. 1B(PRIOR ART)
FIG. 1B is a diagram of a perceived image of the moving object.
Figure 1C:
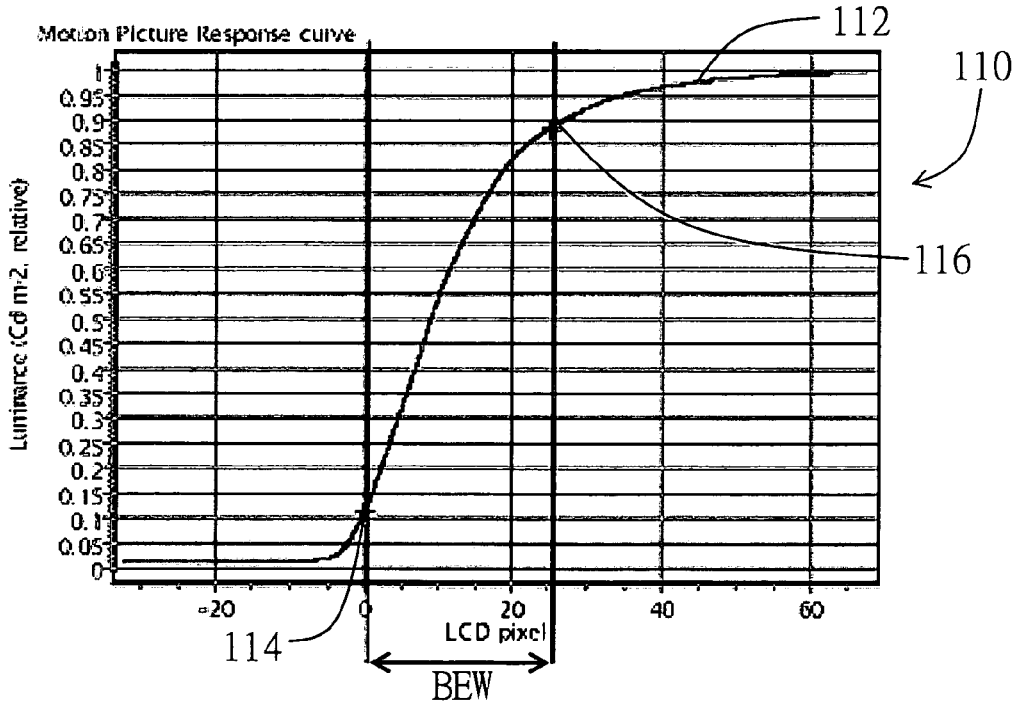
FIG. 1C(PRIOR ART)
FIG. 1C is a graph.
Figure 2:
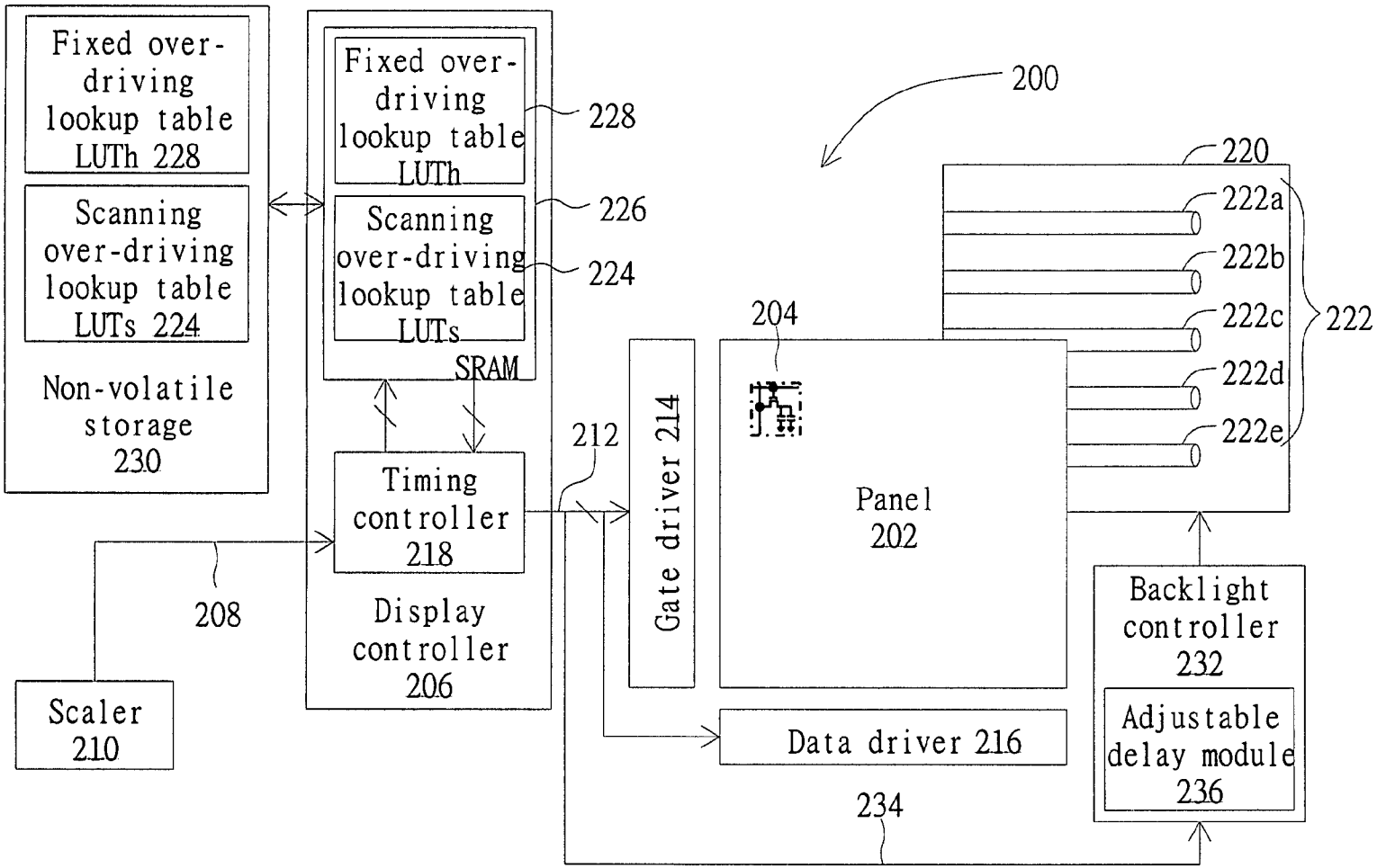
FIG. 2 is a schematic diagram of a liquid crystal display.

Referring to FIG. 2, an example of a liquid crystal display 200 includes a display panel 202 having an array of pixel circuits 204 (only one is shown) for showing pixels of images. A backlight module 220 having lamps 222*a* to 222*e* (collectively 222) provides light to the panel 202, the light being modulated by the pixel circuits 204 to form images. The pixel circuits 204 can be overdriven to achieve a fast response. The overdrive function can also be turned off so that the pixel circuits are driven using normal data voltages. The driving of the light from the backlight module 220 relative to the driving of the pixel circuits 204, and the amount of overdrive of the pixel circuits (if overdrive is used), are controlled such that the pixel circuits 204 can exhibit desired brightness levels within a short amount of time, e.g., within one frame period (the time duration for displaying a frame).

The backlight module 220 can be a "scanning backlight module" that is configured to generate light having a luminance that varies periodically to reduce blurring of motion pictures due to persistence of vision. The backlight module 220 can also be a "hold type backlight module" that is configured to generate light having a substantially constant luminance. The light emitting devices 222 can be, e.g., cold cathode fluorescent lamps (CCFLs) or light emitting diodes (LEDs). The light emitted by the light emitting devices 222 will be referred to as the backlight.

The display 200 includes a display controller 206 for processing pixel data used to drive the pixel circuits 204. The display controller 206 receives clock signals, pixel data, and control signals 208 from a scaler 210, which performs scaling functions so that images from a host device (e.g., a computer, not shown) can be scaled to a proper size and resolution suitable to be shown on the display panel 202. The display controller 206 sends pixel data, clock signals, and control signals 212 to one or more gate drivers 214 and one or more data drivers 216, which in turn drive the pixel circuits 204.

The display controller 206 includes a timing controller 218 for processing the pixel data from the scaler 210 and, among other functions, generating overdrive pixel data for overdriving the pixel circuits 204. The display 200 includes a non-volatile storage (such as EEPROM) 230 that stores lookup tables, e.g., a fixed overdrive look-up table LUTh 228 and a scanning overdrive look-up table LUTs 224. Each table has values useful for deriving overdrive pixel data for driving pixel circuits 204 from initial gray levels to target gray levels.

In this example, the fixed overdrive look-up table LUTh 228 provides overdrive pixel data for use when the backlight module 220 outputs light having a continuous luminance. The scanning overdrive look-up table LUTs 224 provides overdrive pixel data for use when the backlight module 220 outputs light having a luminance that varies periodically.

The display controller 206 includes an SRAM 226 for storing the lookup tables 224 and 228 used by the timing controller 206 when deriving the overdrive pixel data. The display controller 206 receives a sequence of frames of pixel data from the scaler 210. The SRAM 226 stores the gray level of each pixel of a previous frame Fn−1. When the timing controller 218 receives the gray level g2 of a pixel of a current frame Fn, the timing controller 218 finds the corresponding gray level g1 of the pixel in the previous frame Fn−1 and determines an overdrive gray level OD from the lookup tables based on the gray levels g1 and g2. For example, if the gray level g2 is higher (or lower) than the gray level g1, the overdrive gray level can be slightly higher (or lower) than the gray level g2, so that the gray level g2 is reached faster.

Depending on the configuration of the backlight module 220, the timing controller 218 selects overdrive pixel data from one of the lookup tables 224 and 228, and sends the overdrive pixel data to the data driver 216 for driving the pixel circuits 204 so that each pixel circuit 204 reaches a target luminance within one frame period. If the backlight module 220 is a "hold type" backlight in which the output light has a continuous luminance, the fixed overdrive lookup table LUTh 228 is selected. If the backlight module 220 is a "scanning type" backlight in which different lamps 222*a* to 222*e* turns on at different times, the scanning overdrive lookup table LUTh 228 is selected.

In some examples, the backlight module 220 can have a third configuration by operating as a "flash type" backlight in which the lamps 222 simultaneously turn on and off periodically. The non-volatile storage 230 can have a third overdrive lookup table that stores overdrive pixel data for use when the backlight module 220 operates in the flash type mode. By providing both lookup tables 224 and 228, the display controller 206 can be used with different types of backlight modules 220.

Below is a description of a display 200 using a scanning type backlight module 220 in which the light emitting devices 222*a* to 222*e* have luminance that vary periodically, and different light emitting devices 222*a* to 222*e* are turned on at different times. A backlight controller 232 controls the light-emitting devices 222 to vary the luminance at a frequency substantially equal to a frame rate. For example, if the liquid crystal display 200 shows 60 frames per second, the frame period is 1/60 seconds, and the liquid crystal display 200 drives the light-emitting devices 222 at a frequency of 60 Hz and a period of 1/60 second.

Driving the light emitting devices 222 at a frequency of 60 Hz means that the light emitting devices 222 are driven so that the luminance of each light emitting device 222*a* to 222*e* varies at a frequency of 60 Hz. For example, the light emitting devices 222 can be turned on and off 60 times per second. When the light emitting devices 222 are turned on or off, the luminance does not reach a maximum value or drop to a minimum value immediately. The luminance may gradually increase and decrease periodically and have a waveform similar to a sine wave. The voltage signal used to drive the light emitting devices 222 may be an AC signal that has a frequency higher than the frequency at which the luminance varies. For example, the AC signal may have a frequency of 1000 Hz or higher. Thus, driving the light emitting device 222 at a frequency of 60 Hz may be performed by alternately applying an AC signal having a frequency of 1000 Hz for 1/120 seconds and turning off the AC signal for 1/120 seconds.

The backlight controller 232 receives a synchronization signal 234 from the timing controller 218 or the host device (not shown) so that the variations in luminance of the backlight can be synchronized with the driving of the pixel circuits 204. The backlight controller 120 includes an adjustable delay module 122 for adjusting the amount of delay in the phase of the backlight relative to the driving of the pixel circuits 204.

The light from the backlight module 220 is modulated by the pixel circuits 204 to generate modulated light. When the pixel circuits 204 are driven from one state to another state having a different transmissivity, the light modulated by a pixel circuit 204 has a luminance that is proportional to the product of the luminance of light from the backlight module 220 and the transmissivity of the pixel circuit 204.

If the phase of the light from the backlight module 220 relative to the driving of the pixel circuits 204 is not controlled properly, the modulated light may not be able to achieve a targeted luminance within one frame period. This may adversely affect the quality of motion images shown on the display 200.

Figure 3A:
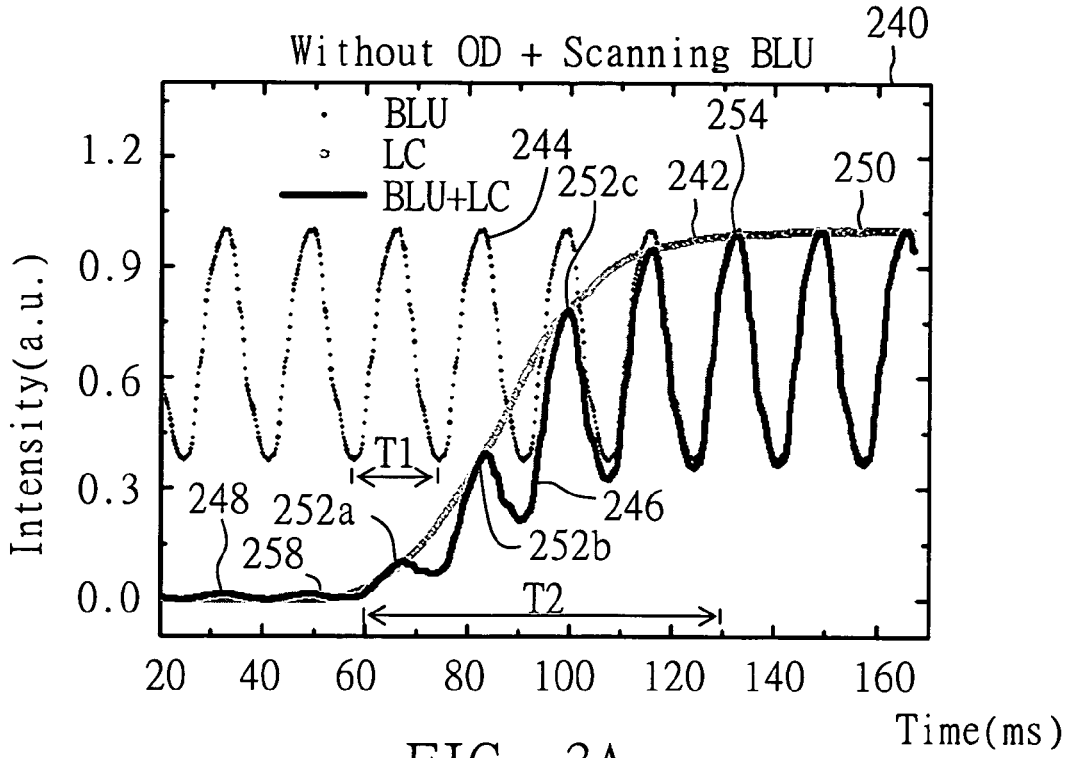
FIGS. 3A to 16 are graphs.

FIG. 3A is a graph 240 that shows a curve 244 representing the periodically varying luminance of the light from the backlight module 220. In this example, it is assumed that the period of the light is substantially the same as a frame period T1. A curve 242 represents the transmittance of a pixel circuit 204 that is driven from a lower transmittance state 248 to a higher transmittance state 250. In this example, the pixel circuit 204 is driven without overdrive so that the pixel circuit 204 transits from the lower transmittance state 248 to the higher transmittance state 250 over a period of time T2 that is equal to several frame periods. A curve 246 represents the luminance of the modulated light.

The curve 246 shows that the modulated light does not reach an intended luminance until about 4.5 frame periods. The curve 246 includes a number of local peaks (e.g., 252*a*, 252*b*, 252*c*), in which the first local peak 252*a* is lower than the second local peak 252*b*, which in turn is lower than the third local peak 252*c*. The luminance of the modulated light increases from a lower value 258 to a target peak value 254 after about 4.5 frame periods. The gradual increase in luminance of the modulated light over several frames may increase the blurring edge width, causing blurring at the edges of motion objects shown on the display 200.

The differences in the first, second, and third local peaks 252*a*, 252*b*, 252*c* and the target peak value 254 may result in double, triple, or more edges, in which the brightness at the edge of a moving object is discontinuous at two, three, or more regions. Suppose a dark object moves on a white background at a speed of several pixels per frame period. As the object moves, pixels near the edges are switched from a low gray level to a high gray level. After four frame periods, there may be three distinct regions trailing behind the moving object, each several pixels wide, that have luminance corresponding to the peaks 252*a*, 252*b*, and 252*c*, resulting in double or triple edges.

Figure 3B:
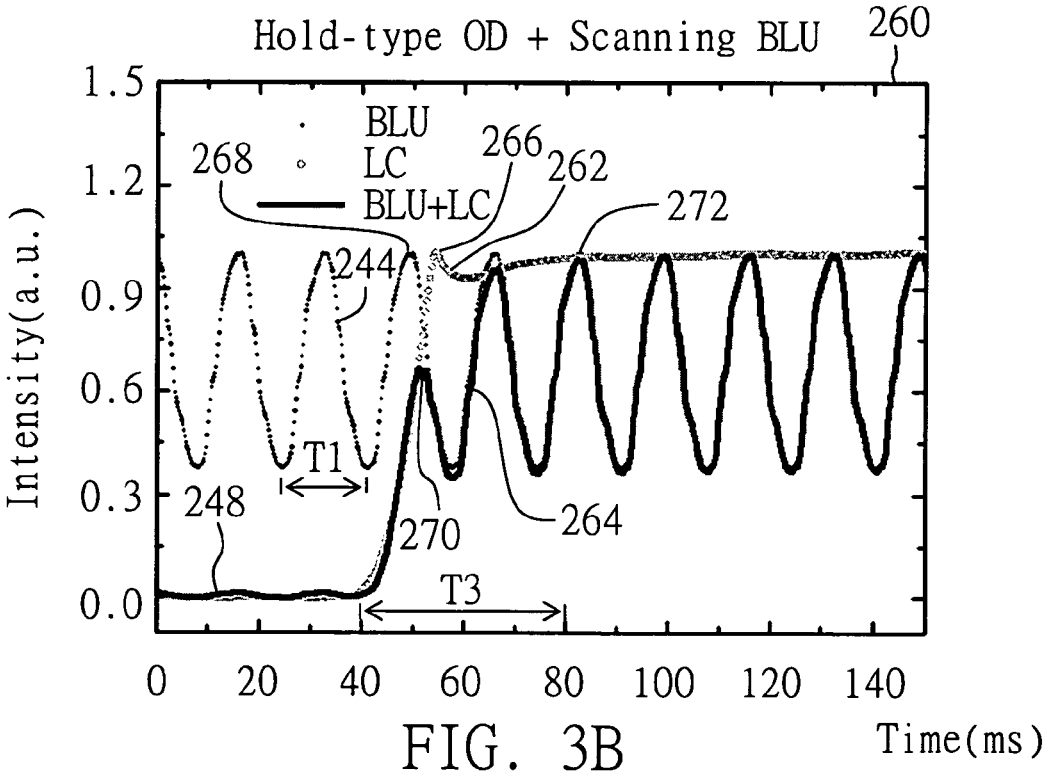

FIG. 3B is a graph 260 that shows the curve 244 representing the light from the backlight module 220 having periodically varying luminance. A curve 262 represents the transmittance of a pixel circuit 204, and a curve 264 represents the luminance of the modulated light. In this example, the pixel circuit 204 is driven using overdrive to reduce the response time.

Although the pixel circuit 204 switches from a low transmittance 248 to a peak transmittance 266 within one frame period T1, the first local peak value 270 of the modulated light 264 is only about 60% of the target peak value 272. The modulated light achieves the target peak value 272 after about 2.5 frame periods. The gradual increase in luminance of the modulated light over 2.5 frames may still cause some blurring at the edges of motion objects shown on the display 200.

The following describes how the blur edge width can be reduced, and the blurring in motion objects can be improved, by adjusting the driving (or the phase) of backlight luminance relative to the driving of the pixel circuits 204. In the examples shown in FIGS. 4A, 4B, 5A, and 5B, the driving frequency of the backlight module 220 is the same as the driving frequency of the pixel circuits 204, and overdrive schemes are not used.

When overdrive is not used, the target gray level of the pixel circuit 204 is sent to the data driver 216 (FIG. 2), which converts the digital gray level to an analog data voltage to drive the pixel circuit 204. Because of the slow response of liquid crystal molecules to the date voltage, it may take several frame periods for the pixel circuit 204 to actually achieve the target gray level.

As described below, when the pixel circuits 204 are driven from a lower transmittance state (lower gray value) to a higher transmittance state (higher gray value), adjusting the phase of the backlight so that the peak value of the backlight occurs slightly after a "gray value switching point" (described below) can reduce blurring. When the pixel circuits 204 are driven from a higher transmittance state to a lower transmittance state, adjusting the phase of the backlight so that the peak value of the backlight occurs slightly before the start of transition from the higher to the lower transmittance states can reduce blurring.

Because some pixels may be transitioning from lower gray values to higher gray values, while other pixels may be transitioning from higher gray values to lower gray values, adjustment of the phase of the backlight relative to the driving of the pixel circuits 204 should take into account both types of transitions. Experiments have shown that, on average, adjusting the phase of the backlight so that the peak value of the backlight occurs slightly before the start of transition from the higher to the lower transmittance states can achieve a better overall response with reduced blurring.

Figure 4A:
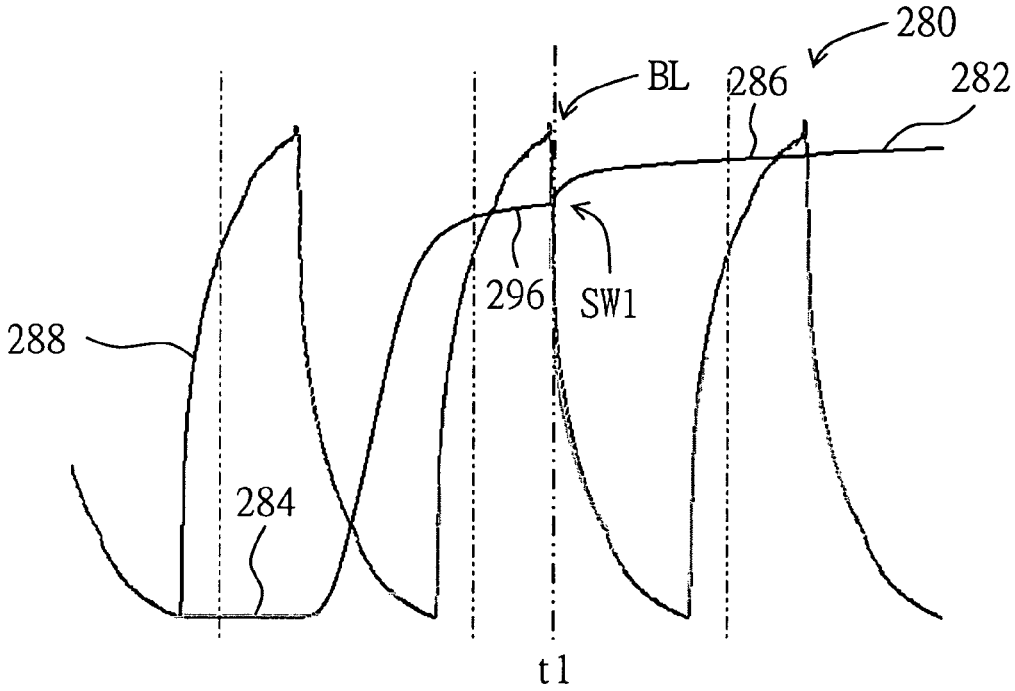
Figure 4B:
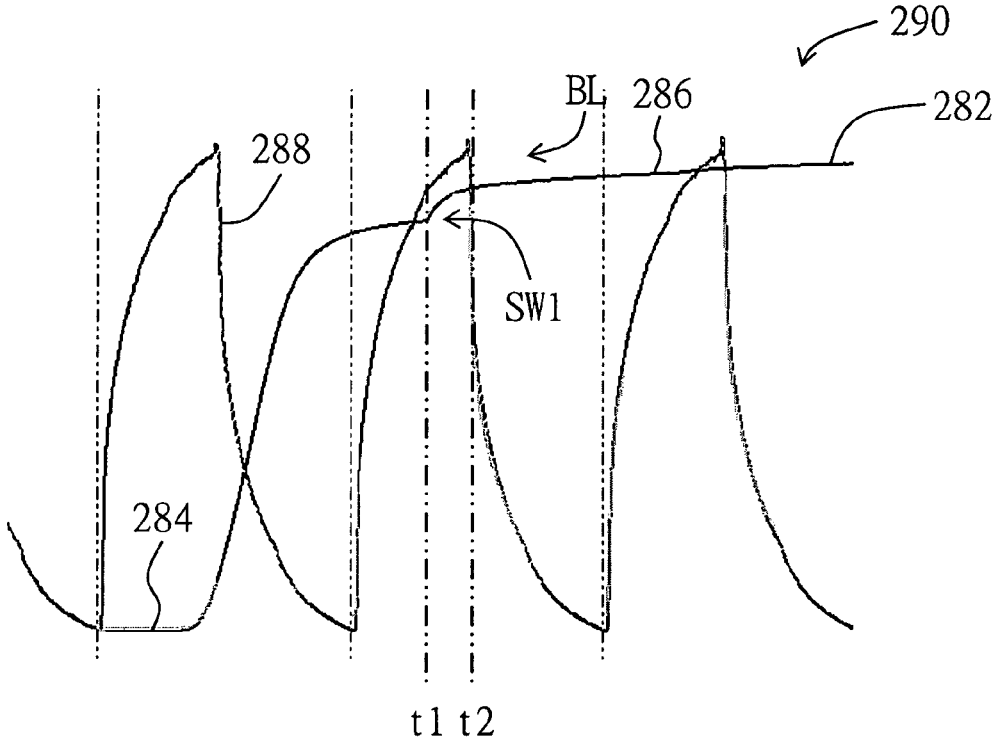

FIGS. 4A and 4B are graphs 280 and 290, respectively, that show a gray level switching curve 282 representing the change in transmittance of a pixel circuit 204 when the pixel circuit 204 switches from a low gray level 284 to a high gray level 286. In the example of FIGS. 4A and 4B, overdrive is not used. A curve 288 represents the luminance of the backlight used to illuminate the pixel circuit 204. The phase of the backlight relative to the driving of the pixel circuit 204 in FIG. 4A is different from that in FIG. 4B.

Because the liquid crystal molecules in the pixel circuit 204 do not necessarily all align at their final positions within one frame period, the pixel circuit 204 changes to an intermediate gray level in a first frame period, then switches (SW1) to the high gray level 286 in a second frame period.

For example, when the backlight module 220 and the pixel circuit 204 have the same driving frequency (e.g., 60 Hz or 120 Hz), the adjustable delay module 236 (FIG. 2) can be initially configured so that a peak BL in the backlight luminance occurs at the same time that the pixel circuit 204 switches (SW1) from the intermediate gray level 296 to the high gray level 286. The time t1 represents the time of switching of gray level and can be used as a reference time point.

Next, the adjustable delay module 236 is adjusted so that the peak BL in the backlight luminance occurs at a time delayed relative to the switching point SW1. The time t2 represents the time of the occurrence of the peak BL after phase adjustment. The time difference |t2−t1| represents a phase lag of the backlight relative to the driving of the pixel circuit 204. The adjustable delay module 236 is adjusted to change the phase lag until a small blur edge width is obtained. For example, if the frame period is 1/60 seconds, the low gray level value is 0 (black) and the high gray level value is 255 (white), a delay of about |t2−t1|=3 ms can result in a reduced blur edge width. The phase lag for achieving the smallest blur edge width can be different for different displays.

Figure 5A:
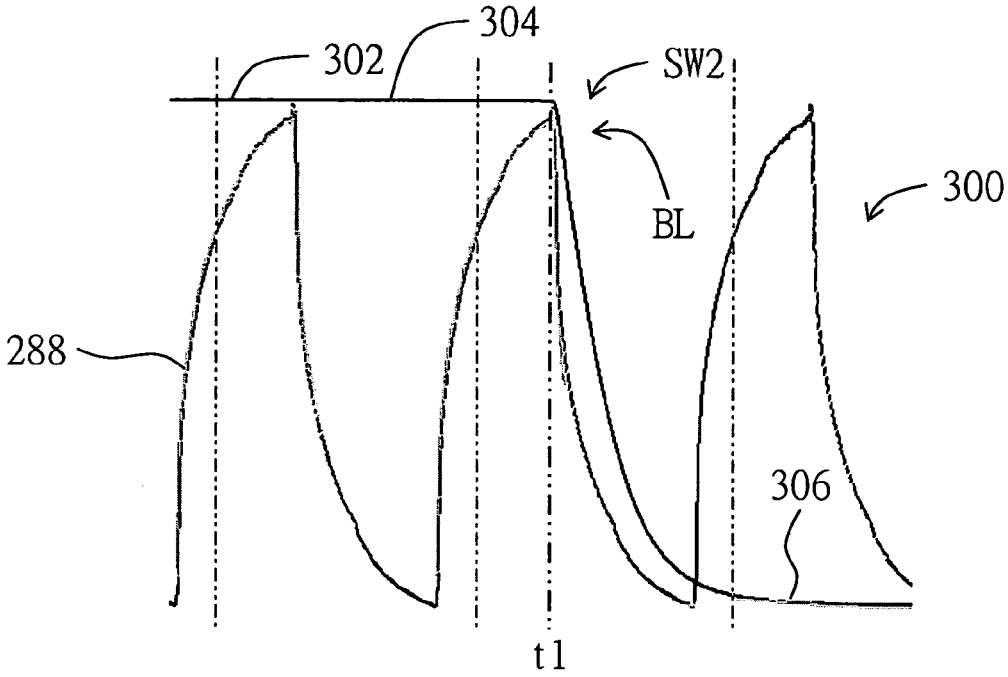
Figure 5B:
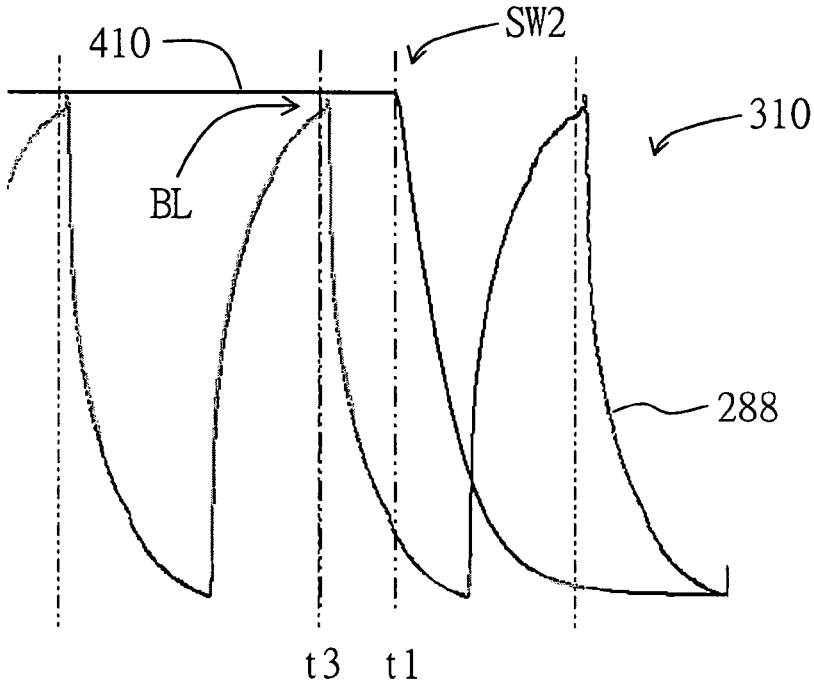

FIGS. 5A and 5B are graphs 300 and 310, respectively, that show a gray level switching curve 302 representing the changes in transmittance of a pixel circuit 204 that switches from a higher gray level 304 to a lower gray level 306. In the example of FIGS. 5A and 5B, overdrive is not used. A curve 288 represents the luminance of the backlight module 220. The phase of the backlight in FIG. 5A relative to the driving of the pixel circuit 204 is different from that in FIG. 5B.

When the backlight module 220 and the pixel circuits 204 have the same driving frequency (e.g., 60 Hz or 120 Hz), the adjustable delay module 236 (FIG. 2) can be initially configured so that a peak BL in the backlight luminance occurs at the same time as the start SW2 of transition from the higher gray level to the lower gray level. The time t1 represents the start SW2 of transition from the higher gray level to the lower gray level, and can be used as a time reference point.

Next, the adjustable delay module 236 is adjusted so that the peak BL in the backlight luminance occurs at a time in advance relative to the switching point SW2. The time t3 represents the time of the occurrence of the peak BL, after adjustment. The time difference |t3−t1| represents a phase advance of the backlight relative to the driving of the pixel circuits 204. The adjustable delay module 236 is adjusted to change the phase advance until a small blur edge width is obtained. For example, if the frame period is 1/60 seconds, the high gray level is 255 (white), and the low gray level is 0 (black), a phase advance of |t1−t3|=4 ms can result in a reduced blur edge width. The phase advance for achieving the smallest blur edge width may be different for different displays.

When both rising and falling of gray levels are considered, on average, adjusting the phase of the backlight so that the peak value BL of the backlight occurs slightly before the reference time point t1 can achieve a better overall response with reduced blurring.

In general, when overdrive is used, the phase of the backlight module 220 is adjusted relative to the driving of the pixel circuits 204 so that the display 200 achieves a better overall optical performance (e.g., lower MPRT). Next, the amount of overdrive used for the various transitions from one gray level to another gray level are determined so that the modulated light has a waveform with a first peak value similar to a target peak value. The target peak value represents the peak value of the modulated light at steady state (when the transmittance of the pixel circuit 204 stabilizes after overdrive), which represents the intended peak value of the modulated light for a specified gray level of the pixel circuit 204.

When overdrive is used with a scanning backlight module 220, an overdrive gray level is retrieved from the lookup table 224 (FIG. 2) and sent to the data driver 216 for overdriving a pixel circuit from an initial gray level to a target gray level. The initial gray level may be the gray level of the pixel of a previous frame, and the target gray level may be the gray level of the pixel circuit in the current frame. If the target gray level is higher (or lower) than the initial gray level, the overdrive gray level can be slightly higher (or lower) than the target gray level, so that the target gray level is reached faster. For example, to switch the pixel circuit 204 from gray level 0 to gray level 96, the data driver 216 may drive the pixel circuit 204 for a short period of time using a driving voltage that corresponds to gray level 190, then return to using a driving voltage that corresponds to gray level 96.

In some examples, the overdrive voltage is applied to the pixel circuit for one frame period. After one frame period, a "normal" voltage is applied to maintain the liquid crystal molecules at the desired orientation so that the pixel circuit produces a desired gray level, until the pixel circuit is driven to a different gray level. In some examples, a frame period is divided into two sub-frame periods. In the first sub-frame period, the overdrive voltage is applied to cause the liquid crystal molecules to quickly change to or near a desired orientation. In the second sub-frame period, the normal voltage is applied to maintain the liquid crystal molecules at the desired orientation, so that the pixel circuit produces a desired gray level. Examples of overdrive techniques are described in U.S. Pat. No. 6,870,530, the contents of which are incorporated by reference.

As described in more detail below, in some examples, the overdrive gray level are designed such that the first peak value of the modulated light is between about 90% to 110% of the target peak value. The first peak value of the modulated light refers to the first peak of the modulated light after the pixel circuit is driven to switch from one gray level to another gray level. The overdrive gray level can also be designed such that a period of the modulated light waveform having the first peak has an integrated value that is between about 90% to 110% of a period of the modulated light waveform having the target peak value.

The amount of overdrive may depend on the relative driving frequencies of the backlight module 220 and the pixel circuits 204. For example, when the driving frequency of the backlight module 220 is about the same as the driving frequency of the pixel circuits 204, for transitions from a lower gray value to a higher gray value, the blur edge width can be decreased by adjusting the phase of the backlight relative to the driving of the pixel circuits 204 so that the transmittance of the pixel circuit 204 reaches a peak value slightly after the occurrence of the peak value of the backlight.

For example, when the driving frequency of the pixel circuits 204 is about twice the driving frequency of the backlight module 220, for transitions from a lower gray value to a higher gray value, the blur edge width can be decreased by adjusting the phase of the backlight relative to the driving of the pixel circuits 204 so that the transmittance of the pixel circuit 204 reaches a peak value slightly before the occurrence of the peak value of the backlight.

Figure 6:
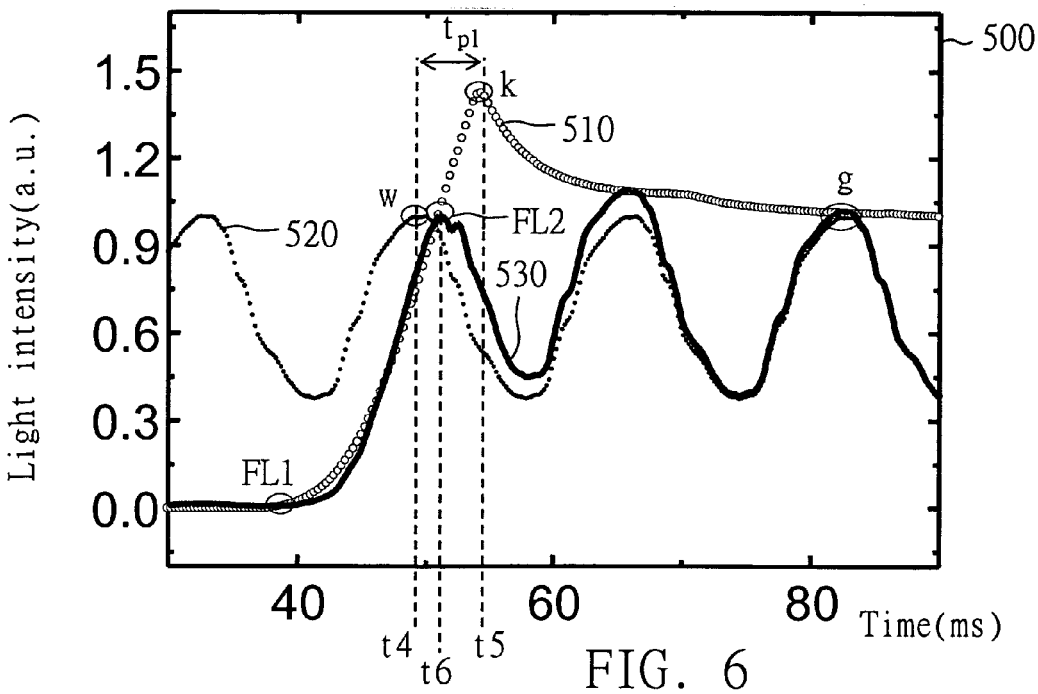

FIG. 6 is a graph 500 that shows a backlight luminance curve 520, a gray level switching curve 510, and a curve 530 representing the luminance of light modulated by the pixel circuit 204 when the backlight module 220 and the pixel circuit 204 have the same driving frequency (e.g., 60 Hz or 120 Hz). The backlight luminance curve 520 represents the luminance of the backlight, and the gray level switching curve 510 represents the transmittance of the pixel circuit 204 as the pixel circuit 204 switches from a lower transmittance (lower gray value) to a higher transmittance (higher gray value).

The curve 510 has a peak k that occurs at time t5. The time t5 represents a switching point in which the overdrive voltage is switched to the normal voltage so that the pixel circuit produces a desired (or target) gray level g. The time t5 can also represent a switching point in which the pixel circuit 204 is driven to another gray level. The time t5 can be used as a reference point for adjusting the phase of the driving of the backlight module 220.

For example, the phase of the backlight luminance curve 520 can be adjusted to be in advance of the phase of the gray level switching curve 510 to decrease the blur edge width. Assume that a peak w (near the peak k) of the curve 520 occurs at time t4. To reduce the overall blur edge width, the time difference $t_{p1}=|t5-t4|$ can be set to be about 0% to 25% of the frame period $T_f$. For example, when the frame time $T_f$ is 1/60 seconds, the time difference $t_{p1}$ can be set to be about 0 to 1/240 seconds to reduce the blur edge width, reducing blurring in motion images shown on the display 200.

The curve 530 shows that the light modulated by the pixel circuit 204 has a first peak FL2 at time t6. The first peak FL2 refers to the first peak after the modulated light starts to change from a lower luminance FL1 to a higher luminance. Typically, the first peak FL2 occurs between the peaks w and k of the curves 520 and 510, respectively.

Figure 7:
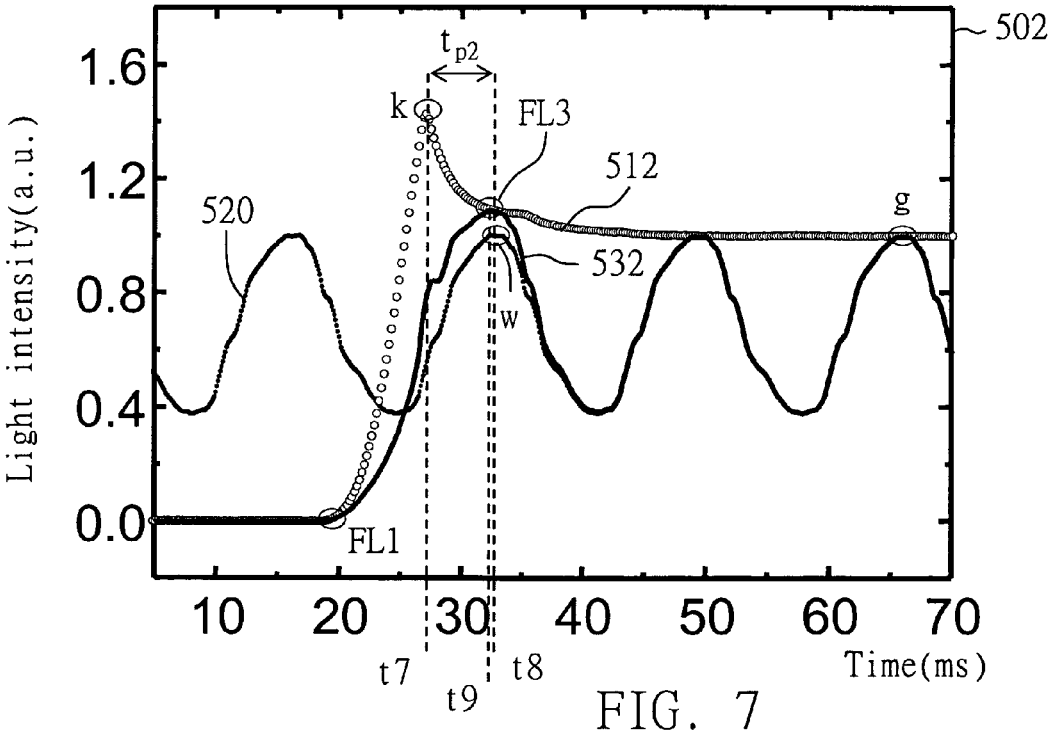

FIG. 7 is a graph 502 that shows a backlight luminance curve 520, a gray level switching curve 512, and a curve 532 representing the luminance of light modulated by the pixel circuit 204 when the backlight module 220 and the pixel circuit 204 have different driving frequencies. For example, the driving frequencies of the backlight module 220 and the pixel circuit 204 can be 60 Hz and 120 Hz, respectively.

The curve 512 has a peak k that occurs at time t7. Time t7 represents a switching point at which the overdrive voltage is switched to the normal voltage so that the pixel produces a desired (or target) gray level g. Time t7 can also represent a switching point in which the pixel circuit 204 is driven to another gray level. The time t7 can be used as a reference point for adjusting the phase of the driving of the backlight module 220.

For example, the phase of the backlight luminance curve 520 can be adjusted to lag behind that of the gray level switching curve 512 by a predetermined time difference $t_{p2}$ to decrease the blur edge width. Assume that a peak w of the curve 520 occurs at time t8. To reduce the overall blur edge width, the predetermined time difference $t_{p2}=|t8-t7|$ can be set to be about 0% to $(1-f_{BLU}/f_{LC})$ of the frame period $T_f$, where $f_{BLU}$ and $f_{LC}$ are the driving frequencies of the backlight module 220 and the pixel circuit 204, respectively. For example, when the driving frequencies of the backlight module 220 and the pixel circuit 204 are 60 Hz and 120 Hz, respectively, the predetermined time $t_{p2}$ can be set to be about 0% to 50% of the frame period $T_f$ to obtain a small blur edge width, reducing blurring in motion images shown on the display 200.

The curve 532 shows that the light modulated by the pixel circuit 204 has a first peak value FL3 at time t9. Typically, the first peak FL3 occurs between the peaks k and w of the curves 512 and 520, respectively.

Figure 8:
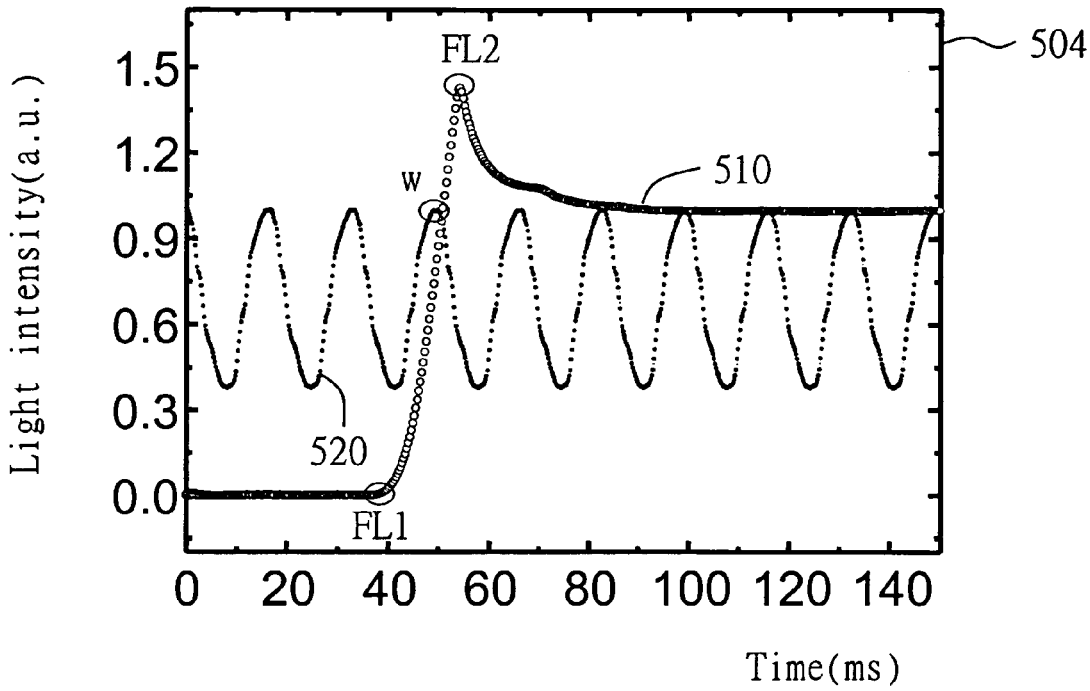
Figure 9:
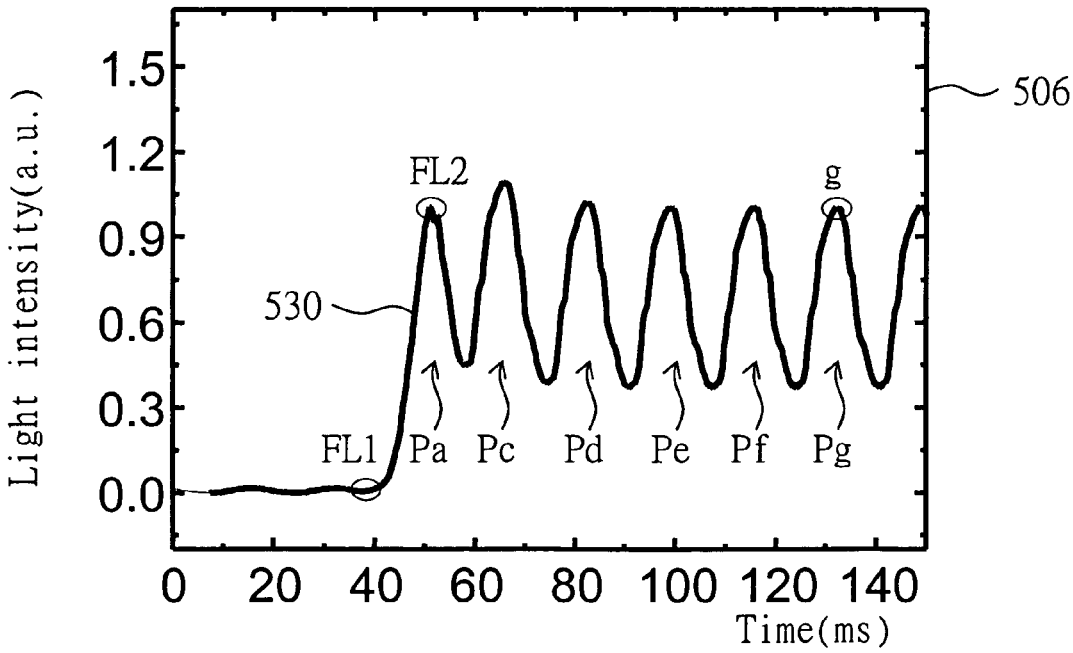

FIGS. 8 and 9 are graphs 504 and 506 that show more clearly the curves 510, 520, and 530 of FIG. 6. As shown in FIG. 8, the phase of the backlight luminance (represented by curve 520) is configured to slightly lead the time of switching from applying an overdrive voltage to applying a normal voltage. As shown in FIG. 9, the modulated light (represented by curve 530) has a series of "pulses" (e.g., Pa, Pc, Pd, Pe, Pf, Pg). The overdrive gray level is selected such that the pulses of the modulated light are substantially uniform. The blurring of motion images can be reduced when the pulses (e.g., Pa to Pg) are more uniform.

There are four methods for selecting the overdrive gray level so that the modulated light reaches a target luminance within one frame period, while also keeping the pulses of the modulated light substantially uniform. In the first method, the overdrive gray level is selected so that the first peak value is similar to the target peak value g. In the second method, the overdrive gray level is selected so that the first and second peak values are similar to the target peak value g. In the third method, the overdrive gray level is selected so that the first pulse Pa has an integrated value that is similar to the integrated value of a pulse Pg having the target peak value g. In the fourth method, the overdrive gray level is selected so that the first and second pulses Pa and Pc have integrated values that are similar to the integrated value of the pulse Pg having the target peak value g.

Figure 10:
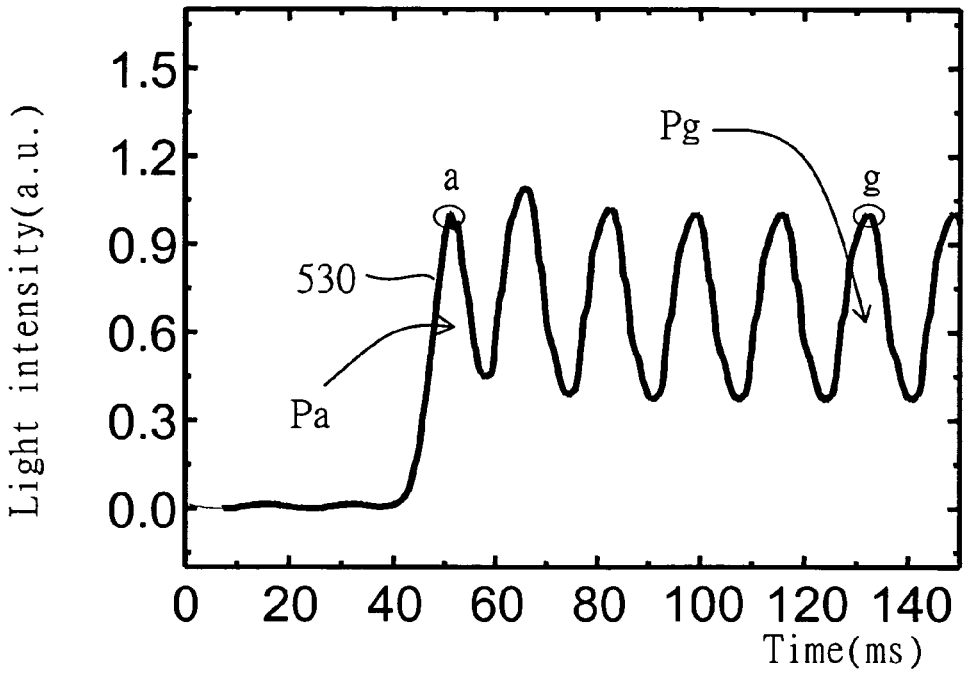

Referring to FIG. 10, according to the first method, the overdrive gray levels stored in the lookup table 224 are configured so that when one of the overdrive gray levels is used to drive the pixel circuits 204, the modulated light has a waveform such that the first pulse Pa has a peak value a that is within 90% to 110% of the target peak value g, i.e., $0.9\,g \leqq a \leqq 1.1\,g$.

Figure 11:
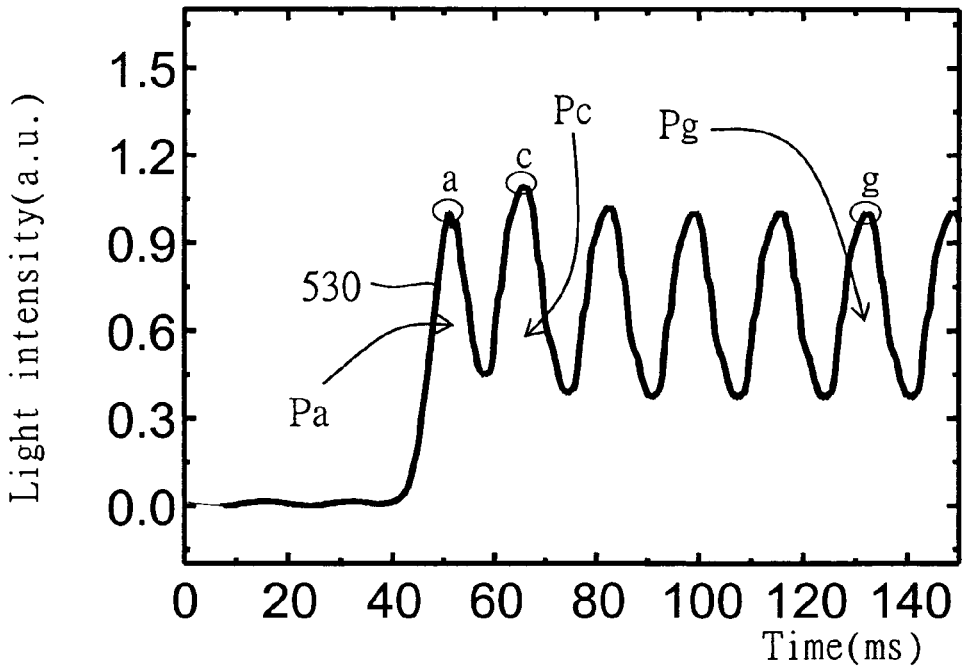

Referring to FIG. 11, according to the second method, the overdrive gray levels stored in the lookup table 224 are configured such that, when one of the overdrive gray levels is used to drive the pixel circuit 204, the modulated light has a waveform such that the first and second pulses Pa and Pc have peak values a and c that are within 90% to 110% of the target peak value g, i.e., $0.9\,g \leqq a \leqq 1.1\,g$ and $0.9\,g \leqq c \leqq 1.1\,g$. By properly limiting the peak value c of the second pulse Pc, the images shown on the display 200 can have a better quality (as compared to just limiting the peak value a).

Figure 12:
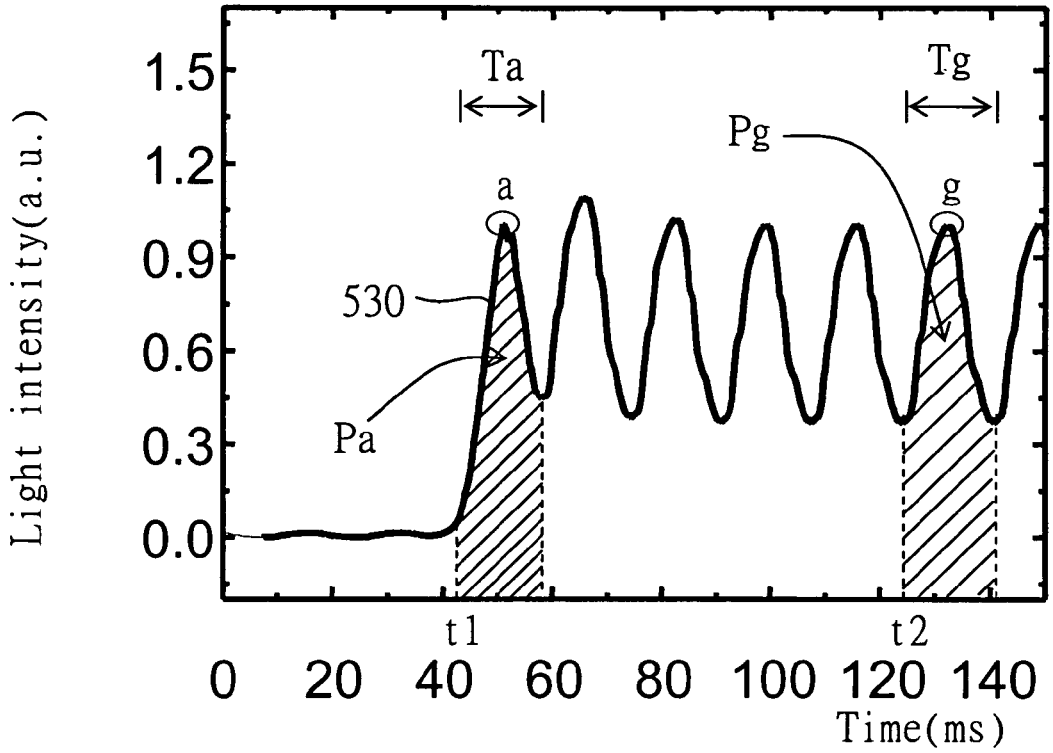

Referring to FIG. 12, according to the third method, the overdrive gray levels stored in the lookup table 224 are configured such that, when one of the overdrive gray levels is used to drive the pixel circuit 204, the modulated light has a waveform such that the first pulse Pa has an integrated value $$\int_{t1}^{t1+Ta} L \cdot dt$$

that is within 90% to 110% of the integrated value $$\int_{t2}^{t2+Tg} L \cdot dt$$

of the target pulse Pg, where L is the luminance of the modulated light, t1 is the start of the first pulse Pa, t2 is the start of the target pulse Pg, Ta is the duration of the first pulse Pa, and Tg is the duration of the target pulse Pg. Thus, in the third method, the integrated value of the first pulse satisfies the criteria:

$$0.9 * \int_{t2}^{t2+Tg} L \cdot dt \leqq \int_{t1}^{t1+Ta} L \cdot dt \leqq 1.1 * \int_{t2}^{t2+Tg} L \cdot dt. \quad \text{(Equ. 3)}$$

Using the integrated values of the pulses to determine the overdrive gray level is useful because the integrated values of the pulses correspond to the brightness of the pulses perceived by the viewer of the display 200. Therefore, when the overdrive gray levels are configured such that the integrated values of the pulses of the modulated light are more uniform, the perceived brightness of the pulses will be more uniform.

Figure 13:
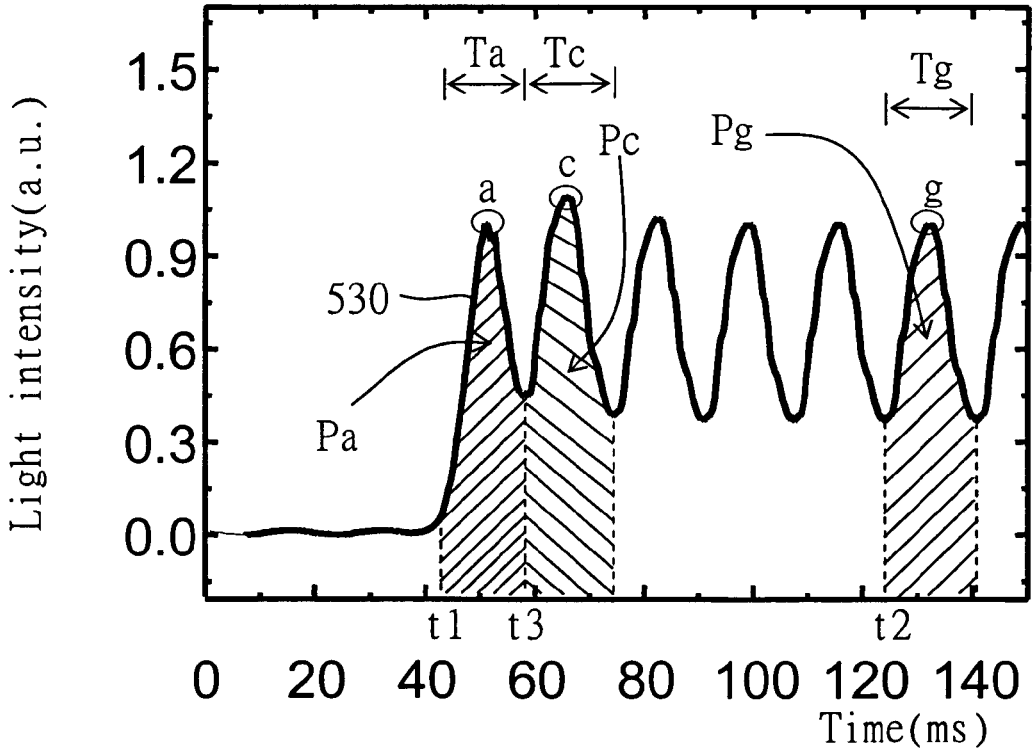

Referring to FIG. 13, according to a fourth method, the overdrive gray levels stored in the lookup table 224 are configured such that, when one of the overdrive gray levels is used to drive the pixel circuit 204, the modulated light has a waveform such that the first pulse Pa and the second pulse Pc have integrated values $$\int_{t1}^{t1+Ta} L \cdot dt \text{ and } \int_{t3}^{t3+Tc} L \cdot dt,$$

respectively, that are within 90% to 110% of the integrated value $$\int_{t2}^{t2+Tg} L \cdot dt$$

of the target pulse Pg. Here, L is the luminance of the modulated light, t1 is the start of the first pulse Pa, t2 is the start of the target pulse Pg, t3 is the start of the second pulse Pc, Ta is the duration of the first pulse Pa, Tg is the duration of the target pulse Pg, and Tc is the duration of the second pulse Pc. Thus, in the fourth method, the integrated values of the first and second pulses satisfy the criteria:

$$0.9 * \int_{t2}^{t2+Tg} L \cdot dt \leqq \int_{t1}^{t1+Ta} L \cdot dt \leqq 1.1 * \int_{t2}^{t2+Tg} L \cdot dt, \quad \text{(Equ. 4)}$$

$$0.9 * \int_{t2}^{t2+Tg} L \cdot dt \leqq \int_{t3}^{t3+Tc} L \cdot dt \leqq 1.1 * \int_{t2}^{t2+Tg} L \cdot dt. \quad \text{(Equ. 5)}$$

The lookup table 224 can be configured such that the criteria described above are met by substantially all of the overdrive gray levels. The lookup table 224 can have, e.g., 40×40=1600 gray level values for use in overdriving the pixel circuit 204 from one of 40 initial gray levels to one of 40 target gray levels. Interpolation can be used to determine the overdrive gray level for initial and target gray levels not specified in the lookup table.

In the third and fourth methods described above, the overdrive gray levels stored in the lookup tables have to be precomputed such that when used to overdrive the pixel circuit 204, the resulting modulated light will meet the criteria described above. The integrated values of simulated or measured luminance of the modulated light are computed for different overdrive gray levels in order to determine which overdrive gray level will satisfy the limitations for the integrated values described above.

Figure 14:
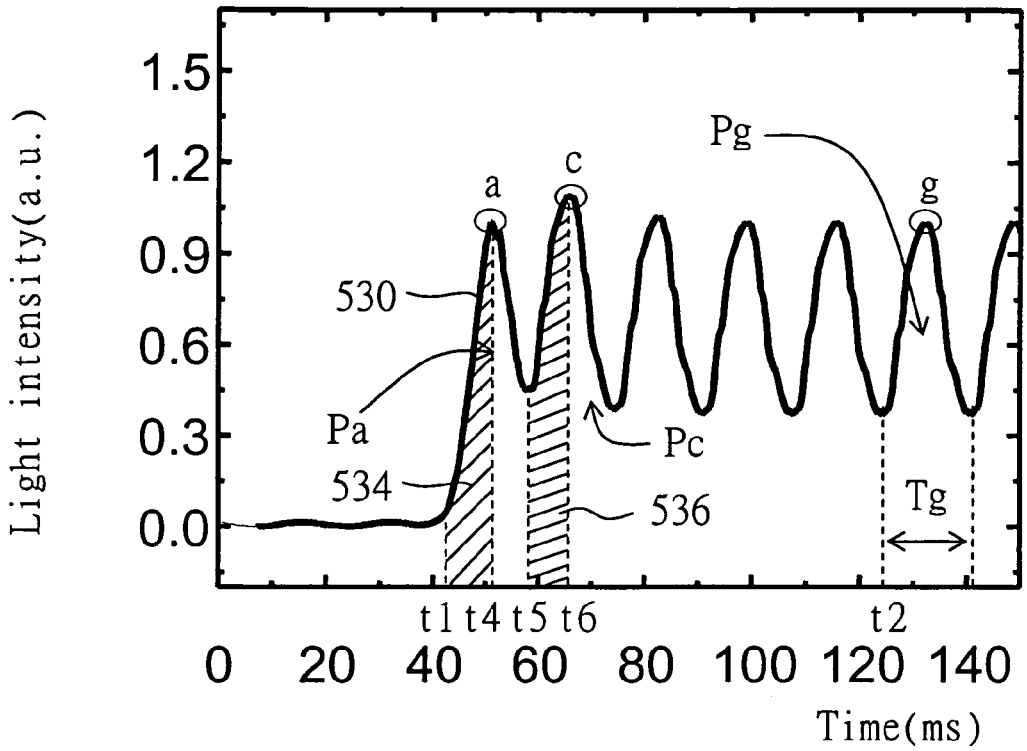

Referring to FIG. 14, as a variation to the third method, a portion 534 of the first pulse Pa can be integrated, instead of integrating the entire period of the first pulse Pa. The integrated value of the first pulse Pa is compared with a fraction of the integrated value of the target pulse Pg. The portion 534 starts from the start t1 of overdriving the pixel circuit 204, to a time t4 when the peak of the first pulse Pa occurs. When testing different overdrive gray levels to find a suitable value, the integrated value of the first pulse Pa changes, but the integrated value of the target pulse Tg remains the same. Thus, integrating only a portion of the first pulse Pa can reduce the amount of computation required for determining the overdrive gray levels.

In the variation of the third method, the integrated value of the portion 534 of the first pulse Pa satisfies the following criteria:

$$0.9*\text{ratio}*\int_{t2}^{t2+Tg} L\cdot dt \leqq \int_{t1}^{t4} L\cdot dt \leqq 1.1*\text{ratio}*\int_{t2}^{t2+Tg} L\cdot dt. \quad \text{(Equ. 6)}$$

In general, the ratio ranges from 0.3 to 0.7. The value of the ratio used for determining a particular overdrive gray level depends on the initial pixel gray level. For example, when the pixel circuit changes from a gray level of 0, 64, or 128 to a higher gray level, the ratio can be, e.g., 0.35, 0.45, and 0.55, respectively. Here, gray level 0 represents black, and gray level 255 represents white. For example, when the pixel circuit changes from a gray level of 128, 192, or 255 to a lower gray level, the ratio can be, e.g., 0.3, 0.6, and 0.7, respectively.

Similarly, as a variation to the fourth method, rather than integrating the entire period of the first and second pulses, the portion 534 and a portion 536 of the second pulse Pc can be integrated. The integrated values are compared with a fraction of the integrated value of the target pulse Pg. The portion 536 starts from the start t5 of the second pulse Pc to a time t6 when the peak of the second pulse Pc occurs.

In the variation of the fourth method, the integrated values of the portions 534 and 536 satisfy the following criteria: and $$0.9*\text{ratio}*\int_{t2}^{t2+Tg} L\cdot dt \leqq \int_{t1}^{t1+Ta} L\cdot dt \leqq 1.1*\text{ratio}*\int_{t2}^{t2+Tg} L\cdot dt, \quad \text{(Equ. 7)}$$

$$0.9*\text{ratio}*\int_{t2}^{t2+Tg} L\cdot dt \leqq \int_{t3}^{t3+Tc} L\cdot dt \leqq 1.1*\text{ratio}*\int_{t2}^{t2+Tg} L\cdot dt. \quad \text{(Equ. 8)}$$

The overdrive gray levels that are determined to satisfy Equs. 3-8 are stored in the lookup table 224 and are used when the backlight module 220 is a scanning type backlight. If the backlight module 220 is a hold type backlight, then the overdrive gray levels stored in the lookup table 228 are used. The following description compares the difference in the edges of motion objects shown on the display 200 when the overdrive gray levels in the lookup tables 224 and 228 are used with a scanning type backlight.

Figure 15:
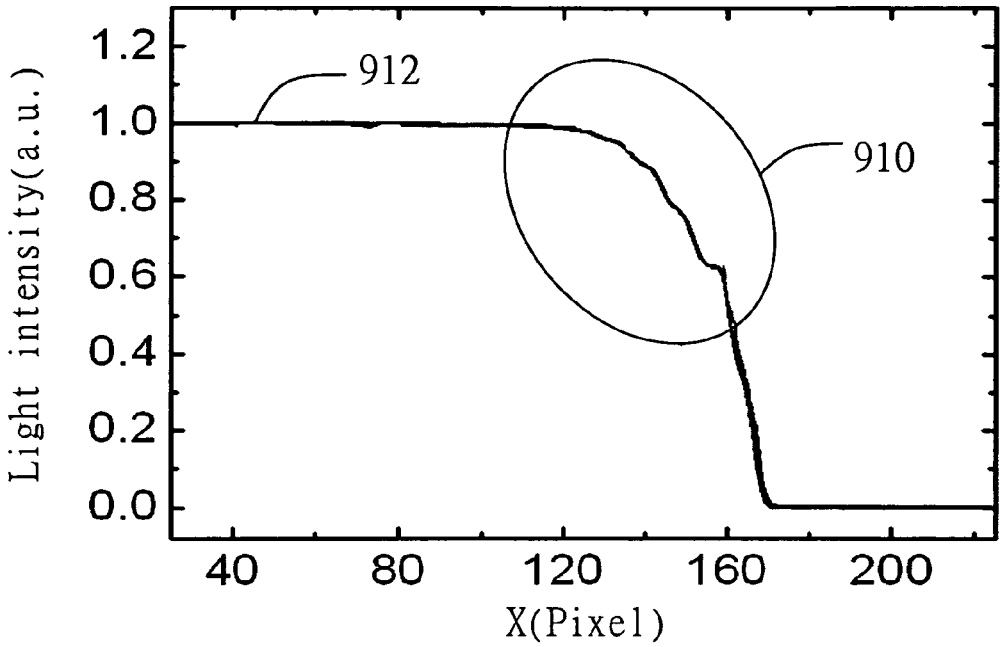

FIG. 15 shows a motion picture response curve 912 representing the perception of an edge of a moving object by a viewer when the overdrive gray levels stored in the lookup table 228 are used to drive the pixel circuits 204. The luminance of the object is normalized to 1, and the luminance of the background is set to 0. The object moves from the right of the screen towards the left side of the screen. The moving object is drawn by successively switching pixel circuits 204 at the edge of the object from the gray level of the object to the gray level of the background as the object moves towards the left side of the screen. The edge of the object as perceived by the viewer is blurred because the edge spans about 40 pixels, as can be seen from a portion 910 of the curve 912 that represents a transition of the perceived brightness at the edge of the object.

Figure 16:
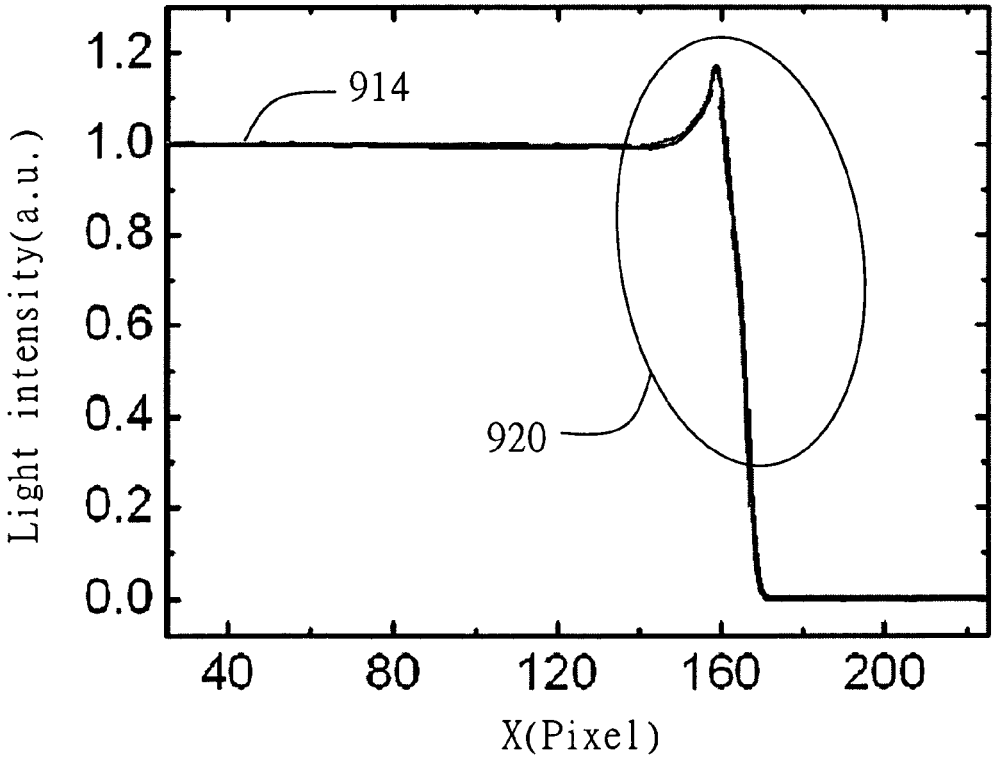

FIG. 16 shows a motion picture response curve 914 representing the perception of an edge of the moving object by the viewer when the overdrive gray levels stored in the lookup table 224 are used to drive the pixel circuits 204. A portion 920 of the curve 914 represents a transition of the perceived brightness at the edge of the object. In this example, the edge as perceived by the viewer is sharper (than that shown in FIG. 4) because the edge (represented by the portion 920) spans only about 10 pixels. A comparison of FIGS. 15 and 16 indicates that, when a scanning type backlight is used, scanning type overdrive gray levels stored in the lookup table 224 will generate better motion images with less blurring at the edges of moving objects (as compared to using the lookup table 228).

The difference in motion image quality can also be quantified using the motion picture response time (MPRT) parameter. FIG. 17 is a table, Table 1, that includes examples of the new blur edge width (N-BET) values for switching between different gray levels when the overdrive gray levels stored in lookup table 228 are used to drive the pixel circuits 204. In Table 1, the values 0, 32, 64, 96, 128, 160, 192, 224 and 255 at the leftmost column represent the initial gray levels, and the values 0, 32, 64, 96, 128, 160, 192, 224 and 255 at the uppermost row represent the target gray levels. The motion picture response time (MPRT) is shown at the bottom right of Table 1. Table 1 shows that the MPRT is about 16.7 ms when the lookup table 228 is used. The definitions of N-BET and MPRT are shown in Equs. 1 and 2, respectively.

FIG. 18 is a table, Table 2, that includes examples of the new blur edge width (N-BET) values for switching between different gray levels when the overdrive gray levels stored in lookup table 224 are used to drive the pixel circuits 204. Table 2 shows that the MPRT is about 12.4 ms when the lookup table 224 is used. A comparison of Tables 1 and 2 shows that when the overdrive gray levels in the lookup table 224 are used, the N-BET and MPRT values are lower, indicating that the motion images will have better quality and with less blurring under various gray level switching conditions.

Figure 19:
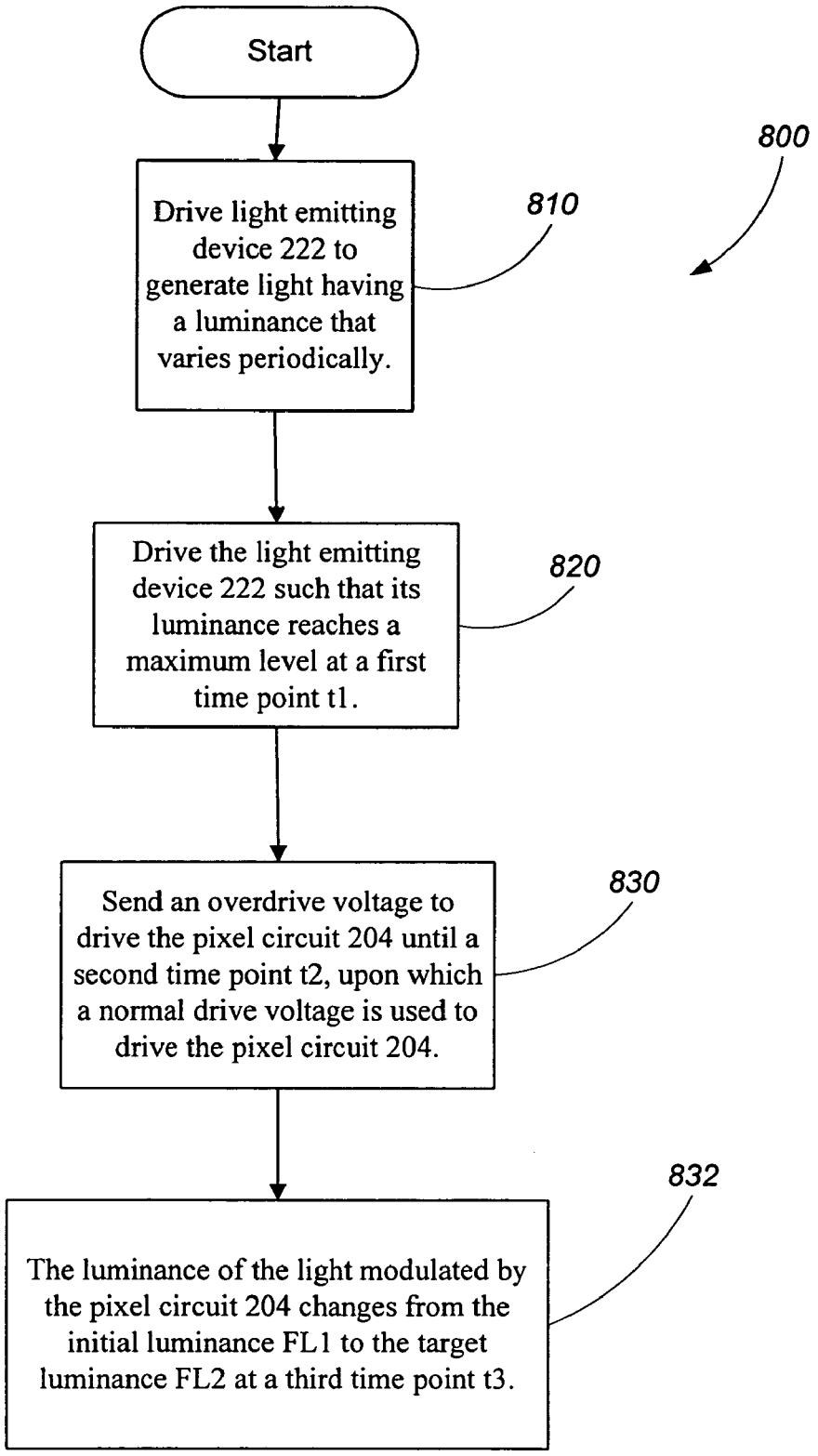
FIGS. 19 and 20 are flow diagrams of processes.

FIG. 19 is a flow diagram of a process 800 for driving the liquid crystal display 200. In process 800, each of the light emitting devices 222 is driven to generate light having a luminance that varies periodically at a frequency that is the same as a frame rate (step 810). The light emitting device 222 is driven such that its luminance reaches a maximum level at a first time point t1 (step 820). The driving circuit 240 sends an overdrive voltage OV to drive the pixel circuit 204 until a second time point t2, upon which the driving circuit 240 sends a normal drive voltage to drive the pixel circuit 204 (step 830) such that the luminance of the light modulated by the pixel circuit 204 changes from the initial luminance FL1 to the target luminance FL2 at a third time point t3 (step 832). The first, second, and third time points are different from one another.

Figure 20:
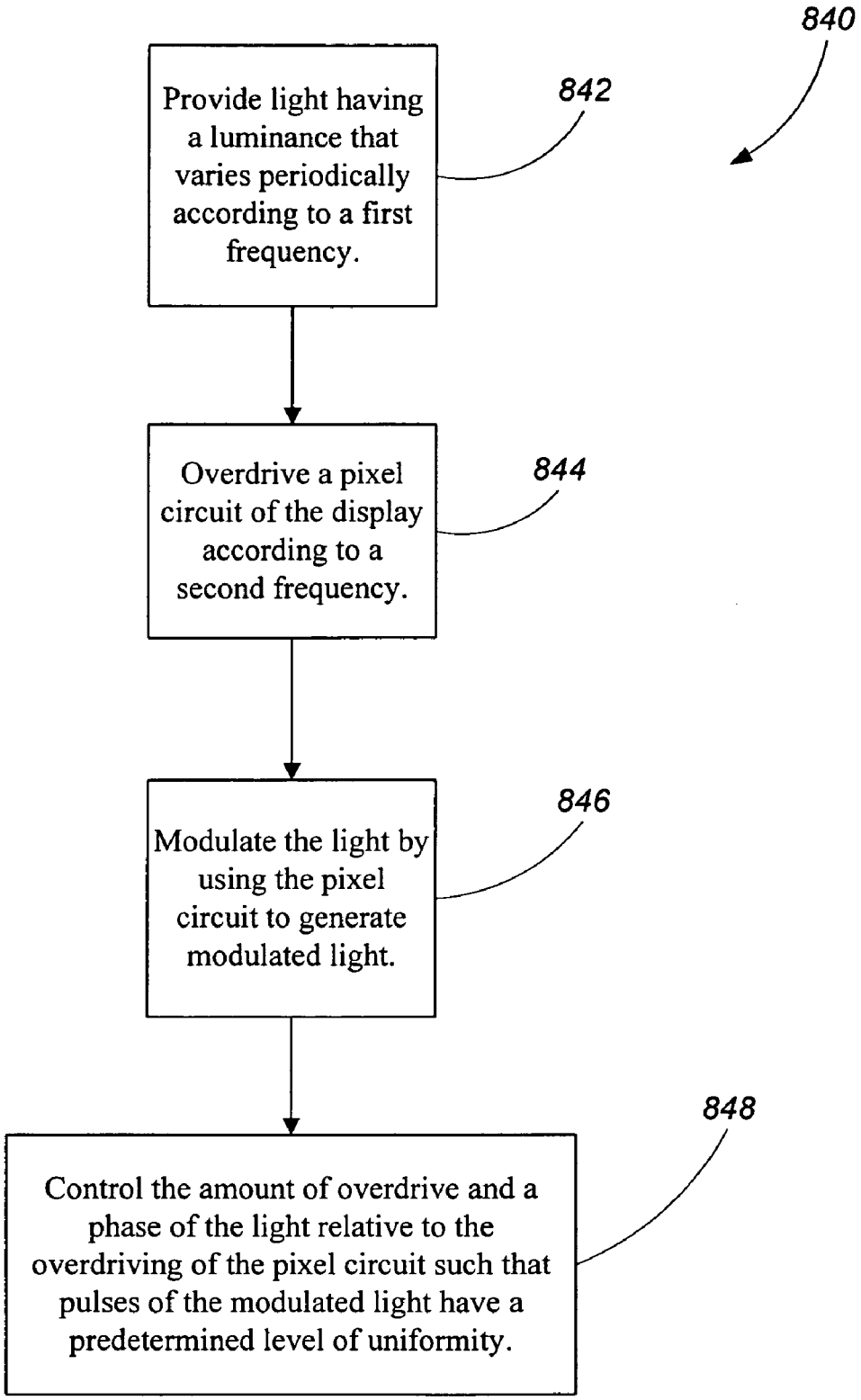

FIG. 20 is a flow diagram of a process 840 for driving the liquid crystal display 200. In process 840, light having a luminance that varies periodically according to a first frequency is provided (step 842). The light can be provided by, for example, the backlight module 220. The pixel circuit 204 of the display 200 is overdriven using overdrive gray levels according to a second frequency (step 844). The first and second frequencies can be the same or different. The overdrive gray levels can be, e.g., stored in a lookup table 224. The light is modulated by using the pixel circuit 204 to generate modulated light (step 846). The amount of overdrive and a phase of the light relative to the overdriving of the pixel circuit 204 are controlled such that pulses of the modulated light have a predetermined level of uniformity (step 848). For example, the peak value of the first pulse can be within 90% to 110% of a target peak value. The peak value of the second pulse can be within 90% to 110% of the target peak value. The integrated value of the first pulse can be within 90% to 110% of the integrated value of the target pulse. The integrated value of the second pulse can be within 90% to 110% of the integrated value of the target pulse.

A number of examples have been described. Nevertheless, it will be understood that various modifications may be made without departing from the spirit and scope of the invention. For example, the light emitting devices 222*a*-222*e* can be controlled in a manner different from what is described above. For example, all of the light emitting devices 222*a*-222*e* can be turned on and off at the same time. Each of the light emitting devices 222*a*-222*e* can be turned on for ⅕ of a frame period, one at a time. The light emitting devices can be turned on two at a time and rotated over a frame period. The light emitting devices 222*a* and 222*b* can be on for ¼ of the frame period, then light emitting devices 222*b* and 222*c* are on for the next ¼ of the frame period, and so forth. The light emitting devices can be turned on three at a time and rotated over a frame period. The light emitting devices 222*a*, 222*b*, and 222*c* can be on for ⅓ of the frame period, then light emitting devices 222*b*, 222*c*, and 222*d* can be on for the next ⅓ of the frame period, and so forth.

The display 200 can have more than one gate driver, and can have more than one data driver. There may be additional overdrive lookup tables stored in the non-volatile storage 230, for example, for use at different display temperatures. The number of light emitting devices 220 can be different from that described above. The display panel 202 can have different sizes. The amount of phase difference between the backlight and the driving of the pixel circuits can be different from those described above. The phase lag or phase advance for achieving the smallest blur edge width can be different for the same display operating at different modes (e.g., different refresh rates). The non-volatile storage 230 can store different phase delay values that are used by the backlight controller 232 at different refresh rates.

The ranges for the first and second peak values, and the integrated values of the first and second pulses, can be different from those described above. The peak value of the first pulse can be within, e.g., 85% to 115%, or 95% to 105% of the target peak value. The peak value of the second pulse can be within, e.g., 85% to 115%, or 95% to 105% of the target peak value. The integrated value of the first pulse can be within, e.g., 85% to 115%, or 95% to 105% of the integrated value of the target pulse. The integrated value of the second pulse can be within, e.g., 85% to 115%, or 95% to 105% of the integrated value of the target pulse. The values of various parameters can be different from those described above. The driving frequency of the backlight module 220 and the driving frequency of the pixel circuits 204 can be different from those described above. Accordingly, other implementations and applications are within the scope of the following claims.

What is claimed is:

1. A method of operating a display, comprising:

providing light having a luminance that varies periodically, the luminance varying continuously between a lower level and a higher level overdriving a pixel circuit of the display to show frames of images modulating the light by using the pixel circuit to generate modulated light; and controlling the amount of overdrive and a phase of the light relative to the overdriving of the pixel circuit such that, during a period that the pixel circuit starts to change from a first gray level to a second gray level and before the pixel circuit starts to change from the second gray level to a third gray level, pulses of the modulated light have a predetermined level of uniformity;

wherein the phase of the light is controlled relative to the overdriving of the pixel circuit such that as the luminance of light is increased or decreased continuously in different time periods and changes from the lower level to the higher level, or from the higher level to the lower level, the lower level luminance occurs at one frame and the higher level luminance occurs at another frame so that a transition of one frame of image to another frame of image occurs at a time when the continuously varying luminance of light is between the lower level and the higher level.

2. The method of claim 1 wherein the amount of overdrive and the phase of the light are controlled to cause the peaks of the luminance of the pulses to have a predetermined level of uniformity.

3. The method of claim 1 wherein the amount of overdrive and the phase of the light are controlled to cause the peaks of the brightness of the pulses to have a predetermined level of uniformity.

4. The method of claim 1 wherein the amount of overdrive and the phase of the light are controlled to cause the first pulse of the modulated light to have a peak value that is not less than a predetermined percentage of a target peak value.

5. The method of claim 4 wherein the peak value of the first pulse is not less than 90% of the target peak value.

6. The method of claim 4 wherein the peak value of the second pulse of the modulated light is not more than a predetermined percentage of the target peak value.

7. The method of claim 6 wherein the peak value of the second pulse is not more than 110% of the target peak value.

8. The method of claim 1 wherein the amount of overdrive and the phase of the light are controlled to cause the first pulse of the modulated light to have a first integrated value that is not less than a predetermined percentage of a second integrated value of a target pulse having a target peak value, the first and second integrated values being determined by integrating the first and target pulses, respectively, over the same length of time.

9. The method of claim 8 wherein the first integrated value is not less than 90% of the second integrated value.

10. The method of claim 8 wherein the second pulse of the modulated light has a third integrated value that is not more than a predetermined percentage of the second integrated value.

11. The method of claim 10 wherein the third integrated value is not more than 110% of the second integrated value.

12. The method of claim 1 wherein the amount of overdrive and the phase of the light are controlled to cause the first pulse to have a first integrated value that is not less than a predetermined percentage of a second integrated value of a target pulse having a target peak value, the first integrated value being determined by integrating the first pulse from the start of driving the pixel circuit to a time that the first pulse reaches a peak value, and the second integrated value being determined by integrating the second pulse over a period of the second pulse.

13. The method of claim 12 wherein the first integrated value is between 30% to 70% of the second integrated value.

14. The method of claim 1, further comprising overdriving a row of pixel circuits of the display and modulating the light using the row of pixel circuits, wherein the amount of overdrive applied to each pixel circuit and the phase of the light are controlled such that, for each pixel circuit, the pulses of the light modulated by the pixel circuit have a predetermined level of uniformity.

15. The method of claim 1 wherein the light varies at a first frequency f1 that is substantially the same as a second frequency f2 at which the pixel circuit is driven.

16. The method of claim 15 wherein when the pixel circuit switches from a lower gray level to a higher gray level, the pixel circuit reaches a maximum transmissivity within less than 1/(2*f1) after the light reaches a local maximum luminance level.

17. The method of claim 1 wherein the light varies at a first frequency f1 that is lower than a second frequency f2 at which the pixel circuit is driven.

18. The method of claim 17 wherein when the pixel circuit switches from a lower gray level to a higher gray level, the pixel circuit reaches a maximum transmissivity within less than (1−f1/f2)*(1/f1) before the light reaches a local maximum luminance level.

19. The method of claim 1 wherein the display comprises a liquid crystal display.

20. A method of designing a display, comprising:

driving pixel circuits of the display according to a first frequency such that, for each pixel circuit, a pixel data voltage for driving the pixel circuit switch to different levels at predefined time points to enable the display to show frames of images;

driving a light source according to a second frequency to generate light having a luminance that varies according to the second frequency, the luminance varying continuously between a lower level and a higher level;

modulating the light using the pixel circuits to generate modulated light representing images; and adjusting the phase of the light relative to the driving of the pixel circuits to reduce blurring of the images;

wherein the phase of the light is adjusted relative to the driving of the pixel circuit such that as the luminance of light is increased or decreased continuously in different time periods and changes from the lower level to the higher level, or from the higher level to the lower level, the lower level luminance occurs at one frame and the higher level luminance occurs at another frame so that a transition of one frame of image to another frame of image occurs at a time when the continuously varying luminance of light is between the lower level and the higher level.

21. The method of claim 20 wherein the phase of the light is adjusted to be in advance of the driving of the pixel circuits such that peaks of the light occur in advance of the predefined time points within less than half a period of a luminance waveform of the light.

22. A method of operating a display, comprising:

providing a first set of overdrive pixel data and a second set of overdrive pixel data within a display;

selecting, using a controller in the display, one of the first and second sets of overdrive pixel data based on whether a light source of the display generates (a) light having a substantially constant luminance or (b) light having a luminance that varies periodically, the luminance varying continuously between a lower level and a higher level;

overdriving pixel circuits of the display using the selected set of overdrive pixel data; and when the light source has a luminance that varies periodically, controlling the phase of the light relative to the overdriving of the pixel circuits such that as the luminance of light is increased or decreased continuously in different time periods and changes from the lower level to the higher level, or from the higher level to the lower level, the lower level luminance occurs at one frame and the higher level luminance occurs at another frame so that a transition of one frame of image to another frame of image occurs at a time when the continuously varying luminance of light is between the lower level and the higher level.

23. The method of claim 22 further comprising, when the luminance of the light varies periodically, modulating the light using the pixel circuits to generate modulated light, and controlling a phase of the light relative to the overdriving of the pixel circuits to cause pulses of the modulated light to have a predetermined level of uniformity.

24. The method of claim 23 wherein the first pulse of the modulated light has a peak value that is not less than 90% of a target peak value.

25. The method of claim 23 wherein the second pulse of the modulated light has a peak value that is not more than 110% of a target peak value.

26. A display, comprising:

pixel circuits;

a light source;

a storage device storing a first set of overdrive pixel data and a second set of overdrive pixel data, the first set of overdrive pixel data for use when the light source generates light having a substantially constant luminance, the second set of overdrive pixel data for use when the light source generates light having a luminance that varies periodically;

a controller to select one of the first set of overdrive pixel data and the second set of overdrive pixel data based on whether the light source generates light having a substantially constant luminance or light having a luminance that varies periodically, the luminance varying continuously between a lower level and a higher level and a driving module for receiving the selected set of overdrive data and overdriving the pixel circuits using the received set of overdrive data to show frames of images;

wherein the controller controls the phase of the light relative to the overdriving of the pixel circuits such that as the luminance of light is increased or decreased continuously in different time periods and changes from the lower level to the higher level, or from the higher level to the lower level, the lower level luminance occurs at one frame and the higher level luminance occurs at another frame so that a transition of one frame of image to another frame of image occurs at a time when the continuously varying luminance of light is between the lower level and the higher level.

27. The display of claim 26 wherein the second set of overdrive pixel data are configured to cause pulses of the modulated light to have a predetermined level of uniformity.

28. The display of claim 27 wherein the second set of overdrive pixel data are configured to cause the first pulse of the modulated light to have a peak value that is not less than 90% of a target peak value.

29. The display of claim 27 wherein the second set of overdrive pixel data are configured to cause the second pulse of the modulated light to have a peak value that is not more than 110% of a target peak value.

30. The display of claim 26 wherein the storage device stores a first lookup table and a second lookup table, the first lookup table comprising the first set of overdrive data, the second lookup table comprising the second set of overdrive data.

31. A display, comprising:

a light source for generating light having a luminance that varies periodically, the luminance varying continuously between a lower level and a higher level;

pixel circuits for modulating the light to generate modulated light;

a driving module for overdriving the pixel circuits using overdrive data; and a controller for controlling a phase of the light relative to the driving of the pixel circuits such that, during a period that the pixel circuit starts to change from a first gray level to a second gray level and before the pixel circuit starts to change from the second gray level to a third gray level, pulses of the modulated light have a predetermined level of uniformity, wherein the controller controls the phase of the light relative to the driving of the pixel circuits such that as the luminance of light is increased or decreased continuously in different time periods and changes from the lower level to the higher level, or from the higher level to the lower level, the lower level luminance occurs at one frame and the higher level luminance occurs at another frame so that a transition of one frame of image to another frame of image occurs at a time when the continuously varying luminance of light is between the lower level and the higher level.

32. The display of claim 31 wherein the controller controls the phase of the light such that the first pulse of the modulated light has a peak value that is not less than a predetermined percentage of a target peak value.

33. The display of claim 32 wherein the peak value of the first pulse is not less than 90% of the target peak value.

34. The display of claim 31 wherein the controller controls the phase of the light such that the second pulse of the modulated light has a peak value that is not more than a predetermined percentage of a target peak value.

35. The display of claim 34 wherein the peak value of the second pulse is not more than 110% of the target peak value.

36. The display of claim 31 wherein each of the pixel circuits comprises a liquid crystal layer.

37. The display of claim 31 wherein the controller controls the phase of the light such that the first pulse of the modulated light has a first integrated value that is not less than a predetermined percentage of a second integrated value of a target pulse having a target peak value, the first and second integrated values being derived by integrating the first and target pulses, respectively, over the same length of time.

38. The display of claim 37 wherein the first integrated value is not less than 90% of the second integrated value.

39. The display of claim 37 wherein the second pulse of the modulated light has a third integrated value that is not more than a predetermined percentage of the second integrated value.

40. The display of claim 39 wherein the third integrated value is not more than 110% of the second integrated value.

41. The method of claim 1 in which providing light comprises providing light having a luminance that varies periodically at a frequency that is equal to or higher than a frame rate of a display, and overdriving a pixel circuit comprises refreshing the pixel circuit at the frame rate.

* * * * *